US011566373B2

(12) United States Patent
Mikoshiba et al.

(10) Patent No.: US 11,566,373 B2
(45) Date of Patent: Jan. 31, 2023

(54) FIBER PROCESSING SYSTEM AND FIBER PROCESSING METHOD

(71) Applicant: SEIKO EPSON CORPORATION, Tokyo (JP)

(72) Inventors: Takao Mikoshiba, Nagano (JP); Kenta Nomura, Nagano (JP); Yoshio Murata, Nagano (JP); Shinichi Miyazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 107 days.

(21) Appl. No.: 17/160,436

(22) Filed: Jan. 28, 2021

(65) Prior Publication Data

US 2021/0238801 A1 Aug. 5, 2021

(30) Foreign Application Priority Data

Jan. 30, 2020 (JP) ..... JP2020-013154

(51) Int. Cl.

| | |
|---|---|
| ***D21C 5/02*** | (2006.01) |
| ***D21B 1/06*** | (2006.01) |
| ***D21H 11/14*** | (2006.01) |
| ***D21F 7/00*** | (2006.01) |

(52) U.S. Cl.

CPC ..... *D21C 5/02* (2013.01); *D21B 1/061* (2013.01); *D21F 7/00* (2013.01); *D21H 11/14* (2013.01)

(58) Field of Classification Search

CPC .. D21C 5/02; D21B 1/061; D21B 1/10; D21F 7/00; D21F 9/00; D21H 11/14; Y02W 30/64; D21G 9/0027

See application file for complete search history.

(56) References Cited

U.S. PATENT DOCUMENTS

2014/0053745 A1* 2/2014 Dawley ..... B41F 13/02 101/228
2015/0247286 A1* 9/2015 Nagai ..... D21F 7/003 162/261

FOREIGN PATENT DOCUMENTS

| | | | | |
|---|---|---|---|---|
| EP | 2784210 | A1 * | 10/2014 | ..... D21B 1/08 |
| JP | H07-003603 | A | 1/1995 | |
| JP | 2000-159410 | A | 6/2000 | |
| KR | 20060041149 | A * | 5/2006 | ..... D21C 5/02 |
| WO | WO-2017082217 | A1 * | 5/2017 | ..... B27N 3/04 |

* cited by examiner

*Primary Examiner* — Jacob T Minskey
*Assistant Examiner* — Matthew M Eslami
(74) *Attorney, Agent, or Firm* — Global IP Counselors, LLP

(57) ABSTRACT

A sheet manufacturing system includes a processing section configured to process a raw material including a fiber, a detection section configured to detect a state of the raw material, a determination section configured to determine, based on a detection result of the detection section and a preset criterion of a raw material state, whether the raw material is suitable for processing in the processing section, a supply section configured to supply, to the processing section, the raw material determined to be suitable for the processing by the determination section, a reception section configured to acquire operation information indicating an occurrence state of an operation hindrance in the processing section, and a setting section configured to set the criterion based on the operation information.

8 Claims, 12 Drawing Sheets

FIBER PROCESSING SYSTEM AND FIBER PROCESSING METHOD

The present application is based on, and claims priority from JP Application Serial Number 2020-013154, filed Jan. 30, 2020, the disclosure of which is hereby incorporated by reference herein in its entirety.

BACKGROUND

1. Technical Field

The present disclosure relates to a fiber processing system and a fiber processing method.

2. Related Art

To date, in order to reuse a product, such as paper, including fiber, a technique for determining whether the product is suitable for reusing is proposed (for example, refer to JP-A-2000-159410). In the apparatus described in JP-A-2000-159410, since single-sided printed paper is reused for copying or the like, a determination is made based on a criterion including a condition as to whether used paper is suitable for reuse, and the used paper is classified into different sizes.

The purpose of the apparatus described in JP-A-2000-159410 is to reuse unprinted side of single-sided printed paper for copying or the like. Accordingly, as criteria for determining whether paper is suitable for reusing, it is possible to use fixed criteria, such as paper without a mark indicating a confidential document, paper in which the black pixels on the printed side of the paper occupy about less than or equal to 5%, and the like. In contrast, when paper or the like is dissolved and recycled, it has been insufficient to determine whether the paper or the like, which is the raw material, is suitable for recycling by using a method of setting fixed criteria for determining whether the raw material is suitable for recycling.

SUMMARY

According to an aspect of the present disclosure, there is provided a fiber processing system including: a processing section configured to process a raw material including a fiber; a detection section configured to detect a state of the raw material; a determination section configured to determine, based on a detection result of the detection section and a preset criterion of a raw material state, whether the raw material is suitable for processing in the processing section; a supply section configured to supply, to the processing section, the raw material determined to be suitable for the processing by the determination section; an acquisition section configured to acquire operation information indicating an occurrence state of an operation hindrance in the processing section; and a setting section configured to set the criterion based on the operation information.

According to another aspect of the present disclosure, there is provided a fiber processing method for processing a raw material including a fiber, the method including: detecting a state of the raw material; determining, based on a detection result of the state of the raw material and a preset criterion of a raw material state, whether the raw material is suitable for processing; supplying, to a processing section performing the processing, the raw material determined to be suitable for the processing; acquiring operation information indicating an occurrence state of an operation hindrance in the processing section; and setting the criterion based on the operation information.

DESCRIPTION OF EXEMPLARY EMBODIMENTS

In the following, a detailed description will be given of suitable embodiments of the present disclosure with reference to the drawings.

1. FIRST EMBODIMENT

1.1 Configuration of Sheet Manufacturing System

Figure 1:
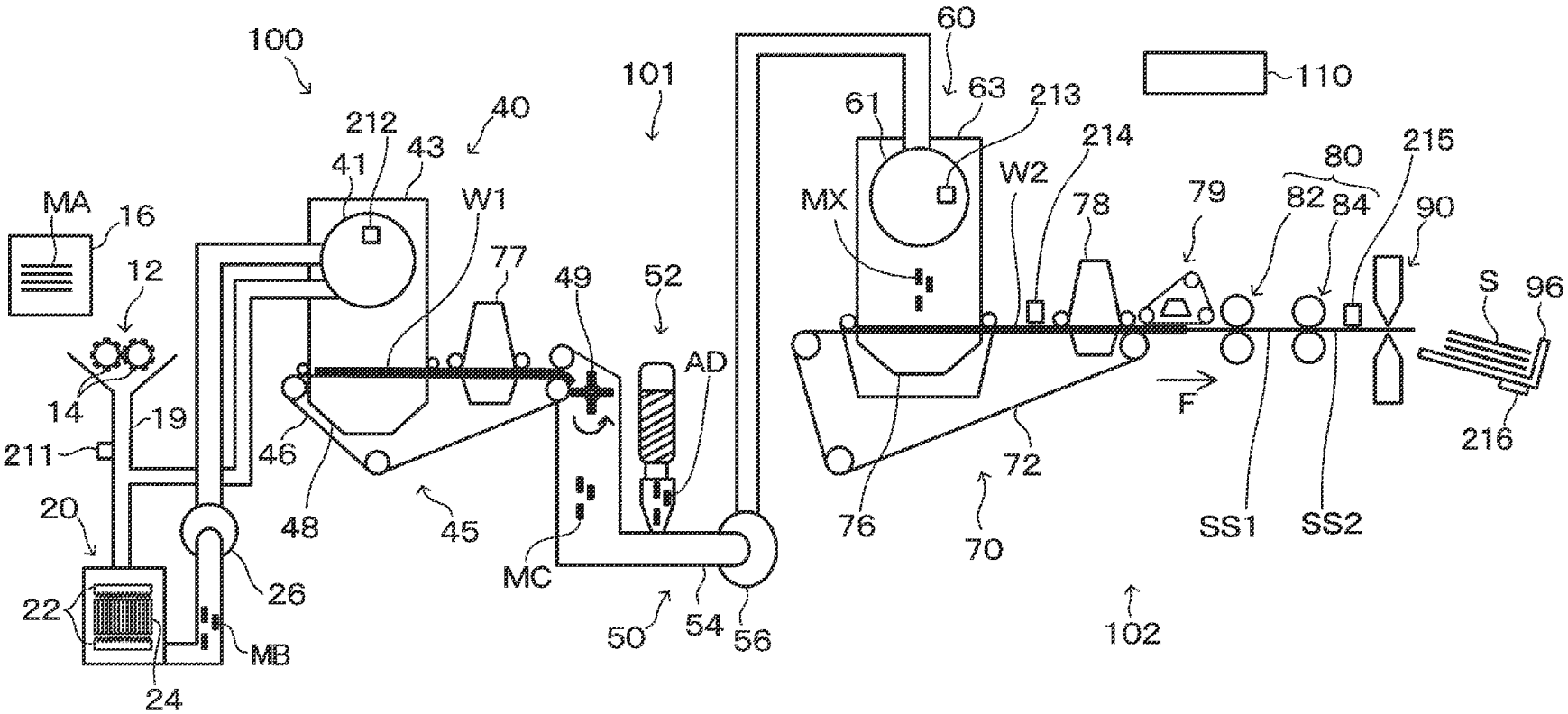
FIG. 1 is a diagram illustrating the schematic configuration of a sheet manufacturing system according to a first embodiment.

FIG. 1 is a diagram illustrating the schematic configuration of a sheet manufacturing system 1 according to the present embodiment. The sheet manufacturing system 1 corresponds to an example of a fiber processing system. The sheet manufacturing system 1 includes a sheet manufacturing apparatus 100 and a separation apparatus 16.

The sheet manufacturing apparatus 100 is an apparatus that fiberizes raw materials including fibers and manufactures recycled sheets. The raw materials used in the sheet manufacturing apparatus 100 ought to be materials that include fibers, such as wood pulp materials, Kraft pulp, used paper, synthetic pulp, and the like, and desirably includes cellulose fibers. Also, the raw materials may include carbon fibers, metal fibers, and thixotropic fibers.

In the present embodiment, the configuration is illustrated in which the separation apparatus 16 supplies raw materials MA to the sheet manufacturing apparatus 100. The raw materials MA supplied by the separation apparatus 16 are sheet-like materials including cellulose fibers. Specifically, the raw materials MA are used paper including standard-size PPC paper and high-quality paper. PPC is an abbreviation of plain paper copy. The raw materials MA are materials produced by printing characters and images on PPC paper or high-quality paper by a printer, or the like, or by being handwritten.

The separation apparatus 16 separates raw materials MA suitable for processing performed by the processing section 101 from raw materials MA unsuitable for the processing and supplies the suitable raw materials MA to the sheet manufacturing apparatus 100. The separation apparatus 16 detects the state of the raw materials MA, that is to say, the raw material state, and determines, based on a detection result and preset criteria, whether the raw materials MA are suitable for processing performed by the processing section 101. The separation apparatus 16 supplies the raw material MA determined to be suitable for the processing performed by the processing section 101 to the sheet manufacturing apparatus 100.

1.2 Configuration of Sheet Manufacturing Apparatus

The sheet manufacturing apparatus 100 fiberizes the raw materials MA supplied from the separation apparatus 16 to produce sheets S. The sheet manufacturing apparatus 100 includes a processing section 101. The processing section 101 includes a coarse crushing section 12, a defibrating section 20, and a forming section 102. The processing section 101 may include each section of a transport blower 26, a selection section 40, a first web forming section 45, and a rotating body 49. The forming section 102 includes a dispersing section 60, a second web forming section 70, and a work-processing section 80, and forms sheets S by using fibers included in defibrated materials MB as materials. The forming section 102 may include a mixing section 50 and a web transport section 79. The sheet manufacturing apparatus 100 corresponds to an example of the processing apparatus.

As described above, the separation apparatus 16 supplies the raw materials MA to the sheet manufacturing apparatus 100, and the raw materials MA are put in the coarse crushing section 12. The coarse crushing section 12 is a shredder that cuts the raw materials MA by a crushing blade 14. The raw materials MA cut by the coarse crushing section 12 are transported to the defibrating section 20 through a pipe 19. The coarse crushing section 12 corresponds to an example of the cutting section.

The pipe 19 is provided with a stagnation sensor 211. The stagnation sensor 211 is a sensor that detects the raw materials MA in the pipe 19. The stagnation sensor 211 may be a sensor that detects the amount of the raw materials MA. Specifically, it is possible to use a reflective light sensor or an ultrasonic sensor. The stagnation sensor 211 may be a sensor that detects the transport speed of the raw materials MA in the pipe 19. Specifically, it is possible to use a wind speed sensor, such as a thermal anemometer, an ultrasonic anemometer, or the like, or a vibration sensor. The stagnation sensor 211 may be a sensor that detects whether the state regarded as stagnation of the raw materials MA is present. Specifically, it is possible to use a reflective light sensor, a transmissive light sensor, or an ultrasonic sensor.

The defibrating section 20 defibrates small pieces cut by the coarse crushing section 12 into defibrated materials MB in a dry process. The defibrating refers to a process for unraveling raw materials MA in the bound state of a plurality of fibers into one or a small number of fibers. A dry process refers to the processing, such as defibrating, or the like performed not in a liquid but in a gas, such as in the air, or the like. The defibrated materials MB include the fibers included in the raw materials MA. Also, the defibrated materials MB sometimes include substances other than fibers that are included in the raw materials MA. For example, when using used paper as the raw materials MA, the defibrated materials MB include coloring agents, such as resin grains, ink, toner, and the like, and ingredients, such as anti-bleeding agent, paper strength enhancer, and the like.

The defibrating section 20 is a mill including, for example, a cylindrical stator 22 and a rotor 24 that rotates in the stator 22, and defibrates the coarse crushed pieces by sandwiching the coarse crushed pieces between the stator 22 and the rotor 24. The transport blower 26 is disposed downstream of the defibrating section 20 and generates an air flow. The defibrated materials MB are transferred to the selection section 40 through the pipe by the air flow generated by the transport blower 26.

The fibers included in the raw materials MA or the fibers included in the defibrated materials MB have a fiber length of 0.1 mm or more and 100 mm or less, preferably have a fiber length of 0.5 mm or more and 50 mm or less. Also, these fibers have a fiber diameter of 0.1 μm or more and 1000 μm or less, preferably have a fiber diameter from 1 μm to 500 μm. Also, these fibers may include a plurality of types of fibers, and may include fibers having a different size of in least one of the fiber length and the fiber diameter.

The selection section 40 includes a drum section 41 and a housing section 43 that accommodates the drum section 41. The drum section 41 is a sieve having openings, such as a net, a filter, a screen, or the like and is rotated by the power of a motor not illustrated in the figure. The defibrated materials MB are unraveled in the rotating drum section 41 and go down through the openings of the drum section 41. Out of the ingredients of the defibrated material MB, the objects that do not pass through the openings of the drum section 41 are transported to the defibrating section 20 through a pipe.

The drum section 41 is provided with a stagnation sensor 212. The stagnation sensor 212 is a sensor that detects the defibrated materials MB in the drum section 41. The stagnation sensor 212 may be a sensor that detects the amount of the defibrated materials MB, and may be a sensor that detects whether the state regarded as stagnation of the defibrated materials MB is present in the drum section 41. Specifically, it is possible to use a reflective light sensor, a transmissive light sensor, or an ultrasonic sensor for the stagnation sensor 212.

The first web forming section 45 includes an endless mesh belt 46 having a large number of openings. The first web forming section 45 accumulates fibers, and the like that fall from the drum section 41 on the mesh belt 46 so as to produce a first web W1. Out of the ingredients that fell from the drum section 41, the objects having a size smaller than the openings of the mesh belt 46 pass through the mesh belt 46 and are removed by suction of the suction section 48.

A humidifying section 77 is disposed in the travel route of the mesh belt 46, and the first web W1 accumulated on the mesh belt 46 is humidified by mist-like water or high humidity air. The first web W1 is transported by the mesh belt 46 and is brought into contact with the rotating body 49. The rotating body 49 divides the first web W1 by a plurality of wings into fiber materials MC. The fiber materials MC are transported to the mixing section 50 through a pipe 54.

The mixing section 50 includes an additive supply section 52 that adds additive materials AD to the fiber materials MC and a mixing blower 56 that mixes the fiber materials MC and the additive materials AD. The additive materials AD crosslink a plurality of fibers so as to bond the fibers with each other to produce sheet-like fibers. The additive materials AD includes resin that functions as a bonding material that binds the fibers with each other, and more specifically includes at least one of thermoplastic resin and thermosetting resin. The additive materials AD may include thermoplastic core sheath resin. Also, the additive materials AD may include a coloring agent, aggregation inhibitor, flame retardant, and the like in addition to the resin described above.

The additive supply section 52 includes a tank that stores additive materials AD and sends the additive materials AD to the pipe 54 under the control of the first controller 110. The mixing blower 56 generates an air flow in the pipe 54, through which the fiber materials MC and the additive materials AD are transported, to mix the fiber materials MC with the additive materials AD and transports a mixture MX to the dispersing section 60.

The dispersing section 60 includes a drum section 61 and a housing section 63 that accommodates the drum section 61. The drum section 61 is a cylindrical sieve configured in the same manner as the drum section 41 and is rotated by being driven by a motor not illustrated in the figure. The mixture MX is unraveled by the rotation of the drum section 61 and falls in the housing section 63.

The drum section 61 is provided with a stagnation sensor 213. The stagnation sensor 213 is a sensor that detects the mixture MX in the drum section 61. The stagnation sensor 213 may be a sensor that detects the amount of the mixture MX, and may be a sensor that detects whether a state regarded as stagnation of the mixture MX is present in the drum section 61. Specifically, it is possible to use a reflective light sensor, a transmissive light sensor, or an ultrasonic sensor for the stagnation sensor 213.

The second web forming section 70 includes an endless mesh belt 72 that includes a large number of openings. The second web forming section 70 accumulates the mixture MX that falls from the drum section 61 on the mesh belt 72 to produce a second web W2. Out of the ingredients of the mixture MX, the objects smaller than the openings of the mesh belt 72 pass through the mesh belt 72 and are sucked by the suction section 76.

A humidifying section 78 is disposed in the travel route of the mesh belt 72, and the second web W2 accumulated on the mesh belt 72 is humidified by mist-like water or high humidity air. A web state detection section 214 is disposed in the travel route of the mesh belt 72. The web state detection section 214 detects the state of the second web W2. For example, the web state detection section 214 detects a place where the second web W2 is torn off, a place where the second web W2 is remarkably thin, a hole of the second web W2, and the like.

For the web state detection section 214, it is possible to use, for example, a reflective light sensor disposed by facing the mesh belt 72, a transmissive light sensor, an image sensor, such as a CCD, a CMOS, and the like. CCD is an abbreviation of Charge Coupled Device, and CMOS is an abbreviation of complementary metal oxide semiconductor. The web state detection section 214 ought to be located downstream of the dispersing section 60 in the transport path of the second web W2. The web state detection section 214 may to be located upstream or downstream of the humidifying section 78.

The second web W2 is removed from the mesh belt 72 by the web transport section 79 and is transported to the work-processing section 80. The work-processing section 80 includes a pressuring section 82 and a heating section 84. The pressuring section 82 sandwiches the second web W2 by a pair of pressure rollers, and pressurizes with a predetermined nip pressure to form pressurized sheet SS1. The heating section 84 sandwiches and heats the pressurized sheet SS1 by a pair of heating rollers. Thereby, the fibers included in the pressurized sheet SS1 are bound by the resin included in the additive materials AD, and a heated sheet SS2 is formed. The heated sheet SS2 is transported to the cutting section 90.

A sheet state detection section 215 is disposed in the route in which the heated sheet SS2 is transported. The sheet state detection section 215 is a detection section that detects the state of the heated sheet SS2, and detects specifically, the whiteness and/or the stiffness of the heated sheet SS2. The sheet state detection section 215 is provided with, for example, a reflective light sensor, a transmissive light sensor, or an image sensor, such as a CCD, a CMOS, or the like as a sensor for detecting the whiteness of the heated sheet SS2. Also, the sheet state detection section 215 includes, for example, a combined configuration of a displaceable lever that presses the heated sheet SS2 and a displacement meter that detects the displacement amount of the lever as a sensor that detects the stiffness of the heated sheet SS2.

The cutting section 90 cuts the heated sheet SS2 in the direction that intersects the transport direction F to produce a predetermined size sheet S. The sheet S is stored in the discharge section 96. The discharge section 96 is provided with a paper discharge amount sensor 216 that detects the amount of sheet S stored in the discharge section 96. The paper discharge amount sensor 216 is, for example, a weight sensor that detects the weight of the sheet S accumulated in the discharge section 96, a light sensor that detects the thickness of the sheet S accumulated in the discharge section 96, a switch sensor, or the like.

In the present embodiment, the sheet manufacturing apparatus 100 fiberizes the raw materials MA in the dry type process to produce the sheet S. However, the sheet manufacturing apparatus 100 may fiberizes the raw materials MA in the wet type process to produce the sheet S. A sheet manufacturing apparatus that fiberizes the raw materials MA in the wet type process to produce the sheet S is disclosed, for example, in JP-A-2011-137251. For example, the used paper processing apparatus disclosed in JP-A-2011-137251 includes a recycling pulp section, a deinking pulp section, a paper making section, a finishing section, and a dewatering processing section. In this configuration, the recycling pulp section disaggregates cut paper pieces of used paper by a pulper to prepare recycled pulp, and corresponds to an example of the processing section.

1.3 Sheet Manufacturing Process

Figure 2:
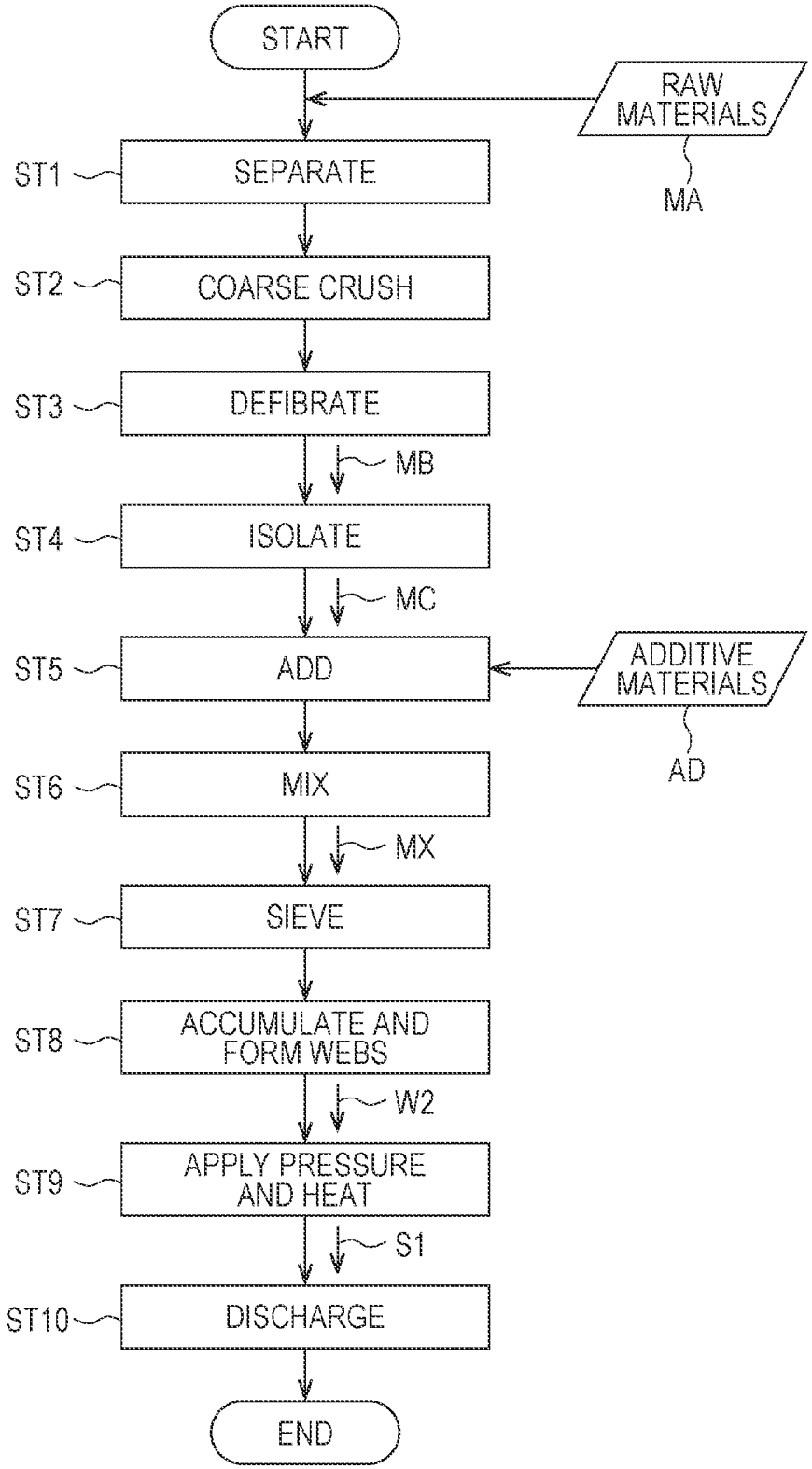
FIG. 2 is a flowchart illustrating an example of a sheet manufacturing process.

FIG. 2 is a flowchart illustrating an example of the sheet manufacturing process of the sheets S, which is performed by the sheet manufacturing apparatus 100. Used paper is supplied to the sheet manufacturing apparatus 100 as raw materials MA. A step ST1 is a separation process that separates the raw materials MA suitable for the processing performed by the processing section 101 from the supplied raw materials MA. The separation process corresponds to, for example, the processing performed by the separation apparatus 16. A step ST2 is a coarse crushing process that coarsely crushes the raw materials MA, and for example, corresponds to the processing by the coarse crushing section 12 in the sheet manufacturing apparatus 100. The coarse crushing process is a process in which the raw materials MA are cut into pieces of a predetermined size or less.

A step ST3 is a defibrating process, and, for example, corresponds to the processing by the defibrating section 20 in the sheet manufacturing apparatus 100. A step ST4 is a process that extracts materials mainly having fibers from the defibrated materials MB, and is referred to as an isolation process. The isolation process is a process that isolates particles of, such as resin, additives, and the like from the defibrated materials MB including the fibers and resin grains, and the like, and extracts materials having fibers as main ingredients. The isolation process corresponds to, for example, the processing performed by the selection section 40 and the rotating body 49 in the sheet manufacturing apparatus 100.

When the raw materials MA supplied in step ST2 does not include particles that affect the production of the sheet S, and the like, or when it is not necessary to remove particles, and the like from the ingredients included in the raw materials MA, it is possible to omit the isolation process of step ST4. In this case, the defibrated materials MB are directly used as the fiber materials MC.

A step ST5 is an addition process, in which additive materials AD are added to the fiber materials MC extracted in step ST4. The addition process corresponds to, for example, the additive supplying section 52 of the sheet manufacturing apparatus 100.

A step ST6 is a mixing process, in which the fiber materials MC and the additive materials AD are mixed to produce mixture MX. The mixing process corresponds to, for example, the processing performed by the mixing section 50 in the sheet manufacturing apparatus 100.

A step ST7 is a sieving process, in which mixture MX is dispersed in the air through a sieve, and is lowered. The sieving process corresponds to, for example, the processing performed by the dispersing section 60 of the sheet manufacturing apparatus 100.

A step ST8 is an accumulating process, in which the mixture MX that falls in the sieving process of step ST7 is accumulated to form a web. The accumulating process corresponds to, for example, the forming process of the second web W2 by the second web forming section 70 in the sheet manufacturing apparatus 100.

A step ST9 is an applying pressure and heat process, in which pressure and heat is applied to the web. The applying pressure and heat process correspond to, for example, the processing in which the second web W2 is heated and pressurized by the work-processing section 80 in the sheet manufacturing apparatus 100, and the second web W2 goes through the pressurized sheet SS1 and the heated sheet SS2 to be formed into a sheet S. The order of pressurization and heating in the applying pressure and heat process is not limited, but it is desirable that pressurization be performed in advance of heating.

A step ST10 is a discharging process, in which the sheet S is discharged. The discharging process corresponds to, for example, the operation to discharge the sheet S to the discharge section 96.

1.4 Configuration of Separation Apparatus

Figure 3:
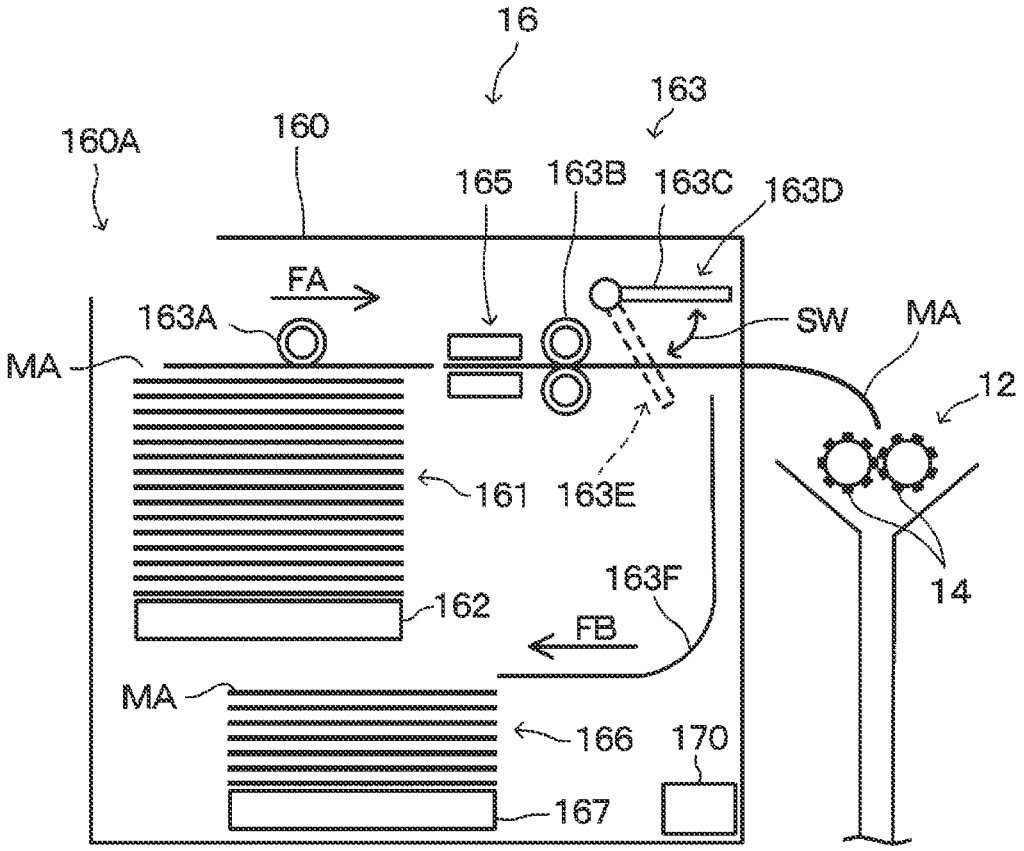
FIG. 3 is a diagram illustrating the configuration of a separation apparatus.

FIG. 3 is a diagram illustrating an example of the configuration of the separation apparatus 16. The separation apparatus 16 includes a casing 160, and a raw material accommodation section 161, a raw material amount sensor 162, a transport section 163, a raw material inspection section 165, a collection tray 166, a collection amount sensor 167, and a second controller 170 are disposed in the casing 160. The transport section 163 corresponds to an example of the supply section that supplies the raw materials MA to the coarse crushing section 12.

The separation apparatus 16 separates the raw materials MA suitable for the processing performed by the processing section 101 from the unsuitable raw materials MA under the control of the second controller 170.

The raw material accommodation section 161 accommodates the raw materials MA put through a slot 160A disposed on the casing 160. The raw material accommodation section 161 is provided with a raw material amount sensor 162. The raw material amount sensor 162 is a sensor that detects the amount of the raw materials MA accommodated in the raw material accommodation section 161, and is, for example, a weight sensor that detects the weight of the raw materials MA accommodated in the raw material accommodation section 161. The raw material amount sensor 162 may be a light sensor that detects the height of the accumulation of the raw materials MA in the raw material accommodation section 161 or a switch sensor. The slot 160A may have an openable lid, and it may be possible to lock the lid by a lock mechanism.

The casing 160 is provided with a collection tray 166. The collection tray 166 accommodates the raw materials MA unsuitable for the processing performed by the processing section 101. A collection amount sensor 167 is disposed on the collection tray 166. The collection amount sensor 167 is a sensor that detects the amount of the raw materials MA accommodated in the collection tray 166, and is, for example, a weight sensor that detects the weight of the raw materials MA accommodated in the collection tray 166. The collection amount sensor 167 may be a light sensor that detects the height of the raw materials MA accumulated in the collection tray 166, or a switch sensor.

The separation apparatus 16 includes a transport section 163 as a mechanism for transporting the raw materials MA. The transport section 163 includes a pickup roller 163A, a supply roller 163B, a switching arm 163C, and a guide 163F. The pickup roller 163A is rotated by a pickup motor 168A described later, and extracts the raw materials MA from the raw material accommodation section 161. The supply roller 163B includes a pair of rollers that nips and rotates the raw materials MA and transports the raw materials MA extracted from the pickup roller 163A.

The switching arm 163C is an arm displaceable from a supply position 163D to a separation position 163E, and may be rod-shaped or plate-shaped. The switching arm 163C switches the transport path of the raw materials MA sent by the supply roller 163B between the route to the coarse crushing section 12 and the route to the collection tray 166. The switching arm 163C guides the raw materials MA sent by the supply roller 163B to the coarse crushing section 12 in the state to be located at the supply position 163D. The switching arm 163C causes the raw materials MA to deviate from the route to the coarse crushing section 12 in the state to be located at the separation position 163E. The guide 163F guides the raw material MA that has deviated from the route to the coarse crushing section 12 to the collection tray 166. The switching arm 163C moves between the supply position 163D and the separation position 163E by the power of an actuator 168B described later.

The raw materials MA are transported by the pickup roller 163A in the direction indicated by a sign FA in FIG. 3 and reaches the supply roller 163B. A raw material inspection section 165 is disposed in the transport path between the pickup roller 163A and the supply roller 163B.

The raw material inspection section 165 detects the state of the raw materials MA and outputs the detection value to the second controller 170. The raw material inspection section 165 is located, for example, upstream of the switching arm 163C in the transport path of the raw materials MA.

Figure 5:
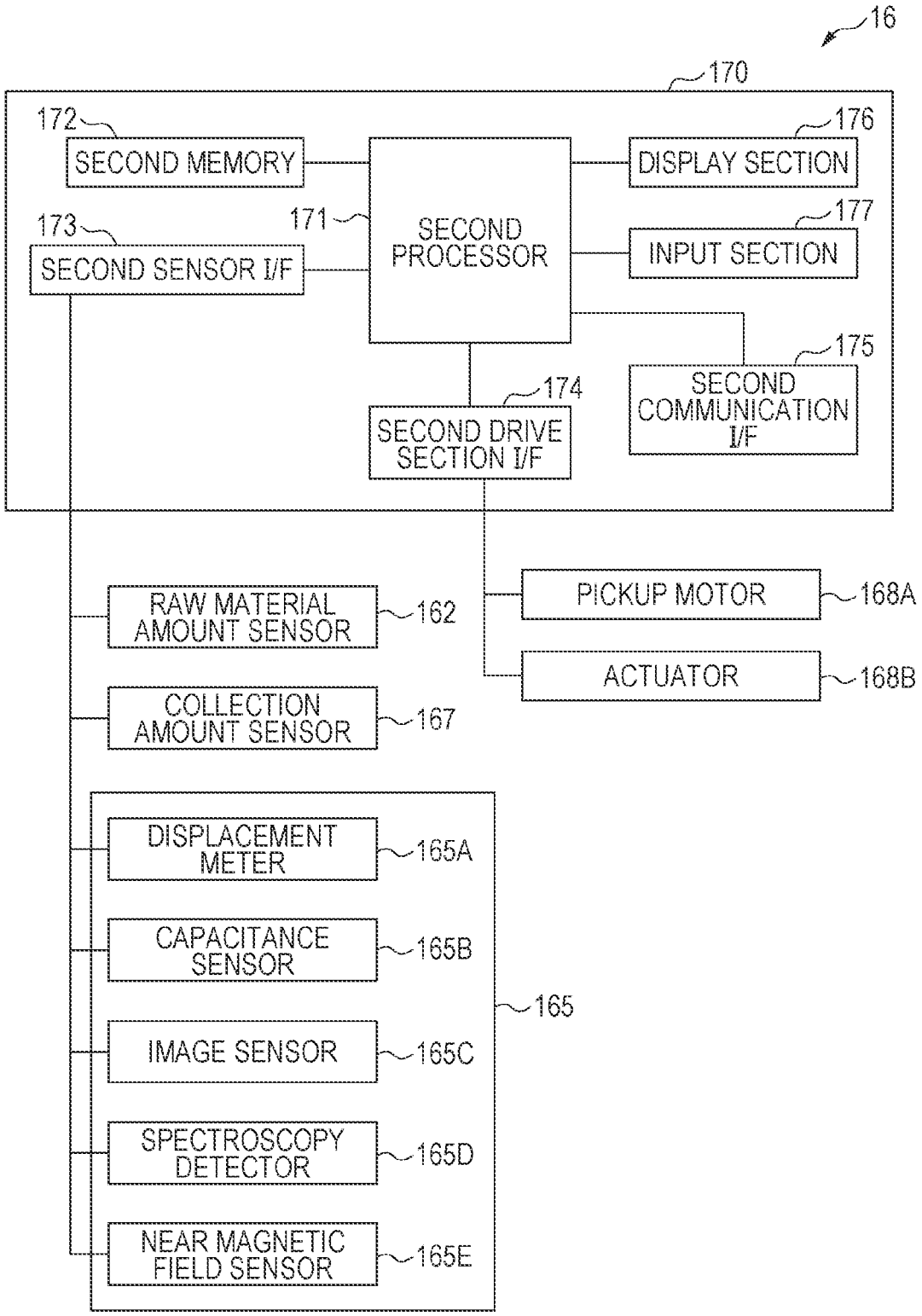
FIG. 5 is a functional block diagram of the separation apparatus.

The raw material inspection section 165 has a plurality of sensors that detect the state of the raw materials MA. The states of the raw materials MA detected by the raw material inspection section 165 include thickness of the raw materials MA, capacitance, loss, such as crease, tear, hole, and the like, print duty, size, generation of recycled paper, whether adhesion of metals is present, and the like. The raw material inspection section 165 may include any type of sensors. In the present embodiment, as an example, the configuration is given that includes a displacement meter 165A, a capacitance sensor 165B, an image sensor 165C, a spectroscopy detector 165D, and a near magnetic field sensor 165E. The individual sensors are illustrated in FIG. 5 described later. The raw material inspection section 165 ought to include at least one of the sensors described above, and it is desirable to include two or more.

The displacement meter 165A is an example of thickness sensors that detect the thickness of the raw materials MA. The displacement meter 165A is configured by including, for example, an optical displacement meter, an eddy current displacement meter, an ultrasonic displacement meter, a laser displacement meter, and a contact displacement meter. The displacement meter 165A detects the height of the surface of the raw materials MA and outputs a detection value to the second controller 170. The displacement meter 165A may obtain the thickness from the detection value of the height of the surface of the raw materials MA and outputs the detection value indicating the thickness of the raw materials MA to the second controller 170.

The capacitance sensor 165B detects the capacitance of the raw materials MA and outputs a detection result to the second controller 170. The image sensor 165C picks up the image of the raw materials MA by an imaging device, such as a CCD, a CMOS, or the like, and outputs image data to the second controller 170. The image sensor 165C ought to pick up the image of at least one of the front and the back of the raw materials MA, and may pick up both of them.

The spectroscopy detector 165D is, for example, a spectroscopy detector including an etalon-type variable wavelength filter and outputs a detection result to the second controller 170. The spectroscopy detector 165D includes a light source that radiates detection light onto the raw materials MA and detects a specific wavelength component of the light reflected on the surface of the raw materials MA, and outputs a detection result to the second controller 170. The near magnetic field sensor 165E detects a magnetic field by a probe disposed in close proximity of the raw materials MA, and outputs a detection result to the second controller 170.

The second controller 170 compares the detection value of each sensor in the raw material inspection section 165 and the detection result with preset criteria so as to determine whether the raw materials MA is suitable for the processing. The second controller 170 operates the switching arm 163C in accordance with a determination result.

After the raw materials MA pass the raw material inspection section 165, the raw materials MA reaches the disposition position of the switching arm 163C. When the switching arm 163C is placed at the separation position 163E, the raw materials MA move in the direction indicated by a sign FB by being guided by the guide 163F and are accommodated in the collection tray 166. When the switching arm 163C is placed at the supply position 163D, the raw materials MA are transported to the coarse crushing section 12 by the power of the supply roller 163B.

1.5. Control System of Sheet Manufacturing Apparatus

Figure 4:
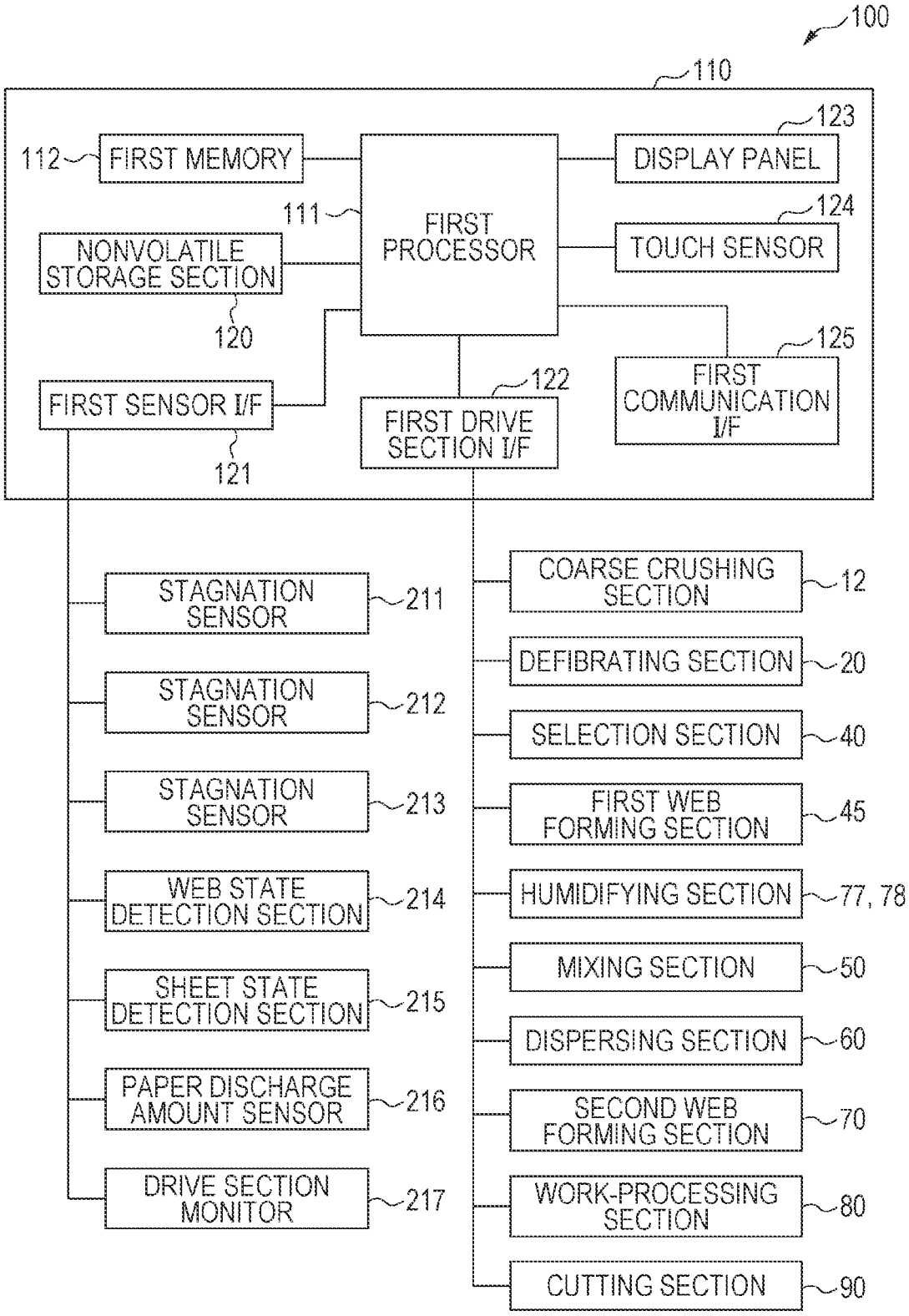
FIG. 4 is a functional block diagram of a sheet manufacturing apparatus.

FIG. 4 is a functional block diagram of the sheet manufacturing apparatus 100. The sheet manufacturing apparatus 100 includes a first controller 110 that controls the operation of the sheet manufacturing apparatus 100. The first controller 110 includes a first processor 111 and a first memory 112. The first processor 111 is an operation processing device including a CPU or an MPU. The first processor 111 executes a control program to control each section of the sheet manufacturing apparatus 100. The first processor 111 may include a single processor or a plurality of processors, or may be formed by a SoC in which a processor is integrated with various circuits including a semiconductor element. Also, all of the functions of the first processor 111 may be implemented by hardware, or the first processor 111 may be configured by using a programmable device. CPU is an abbreviation of central processing unit, MPU is an abbreviation of micro processing unit, and SoC is an abbreviation of System On Chip. The first controller 110 corresponds to an example of the controller.

The first memory 112 is a storage device that stores a program executed by the first processor 111, data to be processed by the first processor 111, and the like. The first memory 112 is a temporary storage device that forms a work area to temporarily store data and a program, and, for example, is a RAM. The first memory 112 may be a nonvolatile storage device that stores a program and data in a nonvolatile manner, for example, may be a semiconductor memory device, such as a flash ROM, or the like, or may be formed by a magnetic storage device. Also, the first memory 112 may be realized in combination of a temporary storage device and a nonvolatile storage device. RAM is an abbreviation of random access memory, and ROM is an abbreviation of read only memory.

The first controller 110 includes a nonvolatile memory 120, a first sensor I/F 121, a first drive section I/F 122, a display panel 123, a touch sensor 124, and a first communication I/F 125. I/F is an abbreviation of interface.

The nonvolatile memory 120 stores various programs executed by the first processor 111, and various kinds of data to be processed by the first processor 111. The display panel 123 is, for example, a liquid crystal display panel and is disposed on the outside of the sheet manufacturing apparatus 100. The display panel 123 displays the operation state of the processing section 101, various setting values, a warning, and the like under the control of the first processor 111.

The touch sensor 124 detects a touch operation and a press operation by a user. The touch sensor 124 is laminated, for example, on the display surface of the display panel 123 and detects the operation on the display panel 123. The touch sensor 124 outputs the operation data including the operation positions and the number of operation positions to the first processor 111 in response to the operation by the user.

The first communication I/F 125 performs data communication with an apparatus other than the sheet manufacturing apparatus 100 under the control of the first processor 111. The first communication I/F 125 may be a communication unit including a connector coupled to a communication cable and a communication interface circuit. Also, the first communication I/F 125 may be a wireless communication module including an antenna and a wireless communication circuit. The first controller 110 performs communication with the separation apparatus 16 via the first communication I/F 125. In the present embodiment, the first communication I/F 125 performs communication with the separation apparatus 16.

The first controller 110 is coupled to a sensor disposed at each section of the sheet manufacturing apparatus 100 via the first sensor I/F 121. The first sensor I/F 121 is an interface circuit that obtains a detection value output from each sensor and inputs the detection value to the first processor 111. The first sensor I/F 121 may include an A/D converter that converts an analog signal output by each sensor into digital data. Also, the first sensor I/F 121 may supply drive power to each sensor. Also, the first sensor I/F 121 may include a circuit that obtains an output value of each sensor in accordance with a sampling frequency specified by the first processor 111 and outputs the output value to the first processor 111.

The first sensor I/F 121 is coupled to stagnation sensors 211, 212, and 213, a web state detection section 214, a sheet state detection section 215, a paper discharge amount sensor 216, and a drive section monitor 217. The first sensor I/F 121 may be coupled to other various sensors not illustrated in FIG. 4.

The drive section monitor 217 monitors a drive current for at least part of the individual drive sections coupled to the first drive section I/F 122. In the present embodiment, the drive section monitor 217 detects a current value and/or a voltage value of the drive current of the motor, not illustrated in the figure, which drives the crushing blade 14 of the coarse crushing section 12. The first controller 110 obtains a current value and/or a voltage value detected by the drive section monitor 217. For example, when clogging of the raw materials MA occurs in the coarse crushing section 12, the load of the motor that drives the crushing blade 14 increases. The first controller 110 monitors the load of the motor driving the crushing blade 14 based on the detection value of the drive section monitor 217 so as to detect clogging of the raw materials MA in the coarse crushing section 12.

The first controller 110 is coupled to each drive section included in the sheet manufacturing apparatus 100 via the first drive section I/F 122. The drive sections included in the sheet manufacturing apparatus 100 are a motor, a pump, a heater, and the like. The first drive section I/F 122 may be coupled to a drive circuit or a drive IC that supplies a drive current to a motor under the control of the first controller 110 in addition to a direct coupling to a motor. IC is an abbreviation of integrated circuit.

As the control target of the first controller 110, the first drive section I/F 122 is coupled to the coarse crushing section 12, the defibrating section 20, the selection section 40, the first web forming section 45, the humidifying sections 77 and 78, a mixing section 50, a dispersing section 60, a second web forming section 70, a work-processing section 80, a cutting section 90, and the like.

The coarse crushing section 12 includes a drive section, such as a motor that rotates the crushing blade 14, and the like. The defibrating section 20 includes a drive section, such as a motor that rotates the rotor 24, a motor that rotates the transport blower 26, and the like. The selection section 40 includes a drive section, such as a motor that rotates the drum section 41, and like. The first web forming section 45 includes a drive section, such as a motor that rotates the mesh belt 46, and the like. The humidifying sections 77 or 78 include a drive section, such as a fan that sends mist-like water or high humidity air, and the like. The mixing section 50 includes a drive section, such as a motor that drives the mixing blower 56, and the like. The dispersing section 60 includes a drive section, such as a motor that rotates the drum section 61, and the like. The second web forming section 70 includes a drive section, such as a motor that rotates the mesh belt 72, and the like. The work-processing section 80 includes a drive section that drives the pressuring section 82 and the heating section 84, a heat source that heats the heating section 84, and the like. The cutting section 90 includes a drive section, such as a motor that operates a blade for cutting the heated sheet SS2, and the like. Also, various drive sections not illustrated in FIG. 4 may be coupled to the first drive section I/F 122.

1.6 Control System of Separation Apparatus

FIG. 5 is a functional block diagram of the separation apparatus 16. The separation apparatus 16 includes the second controller 170 that controls the operation of the separation apparatus 16, and the second controller 170 includes a second processor 171 and a second memory 172. The second processor 171 is an operation processing device including a CPU or a MPU. The second processor 171 executes a control program to control each section of the separation apparatus 16. The second processor 171 may be configured by a single processor, or may be configured by a plurality of processors. The second processor 171 may be configured by a SoC in which a processor is integrated with various circuits including a semiconductor element. Also, all the functions of the second processor 171 may be implemented by hardware or may be configured by using a programmable device.

The second memory 172 is a storage device that stores a program executed by the second processor 171 and data processed by the second processor 171, and the like. The second memory 172 may be a temporary storage device that forms a work area and temporarily stores data and programs, and may be, for example, a RAM. The second memory 172 may be a nonvolatile storage device that stores programs and data in a nonvolatile manner, and may be configured by, for example, a semiconductor memory device, such as a flash ROM, or the like, or a magnetic storage device. Also, the second memory 172 may be realized in combination of a temporary storage device and a nonvolatile storage device.

The second controller 170 includes a second sensor I/F 173, a second drive section I/F 174, a second communication I/F 175, a display section 176, and an input section 177.

The display section 176 displays the operation state of the separation apparatus 16, and the like. The display section 176 may include a display screen, such as a liquid crystal display panel, or the like, or an indicator lamp including a light emitting diode, or the like.

The input section 177 includes an operator, such as a switch operated by a user, or the like, or a touch sensor that detects a touch operation or a press operation by a user. The input section 177 outputs operation data corresponding to an operation by the user to the second processor 171.

The second communication I/F 175 performs data communication with an apparatus other than the separation apparatus 16 under the control of the second processor 171. The second communication I/F 175 may be a communication unit including a connector coupled to a communication cable and a communication interface circuit. Also, the second communication I/F 175 may be a wireless communication module including an antenna and a wireless communication circuit. The second controller 170 performs communication with the sheet manufacturing apparatus 100 via the second communication I/F 175. In the present embodiment, the second communication I/F 175 performs communication with the sheet manufacturing apparatus 100.

The second controller 170 is coupled to a sensor disposed at each section of the separation apparatus 16 via the second sensor I/F 173. The second sensor I/F 173 is an interface circuit that obtains a detection value and inputs the detection value to the second processor 171. The second sensor I/F 173 may include an A/D converter that converts an analog signal output from the sensor into digital data. Also, the second sensor I/F 173 may supply drive power to each sensor. Also, the second sensor I/F 173 may include a circuit that obtains the output value of each sensor in accordance with a sampling frequency specified by the second processor 171 and outputs the output value to the second processor 171.

The second sensor I/F 173 is coupled to each sensor, namely the raw material amount sensor 162, the collection amount sensor 167, and the raw material inspection section 165. That is to say, the displacement meter 165A, the capacitance sensor 165B, the image sensor 165C, the spectroscopy detector 165D, and the near magnetic field sensor 165E are each coupled to the second sensor I/F 173. The second sensor I/F 173 may be coupled to various other sensors not illustrated in FIG. 5.

The second controller 170 obtains a detection value and a detection result of each of the raw material amount sensor 162, the collection amount sensor 167, and the raw material inspection section 165 via the second sensor I/F 173.

The second controller 170 is coupled to each drive section included in the separation apparatus 16 via the second drive section I/F 174. The drive sections included in the separation apparatus 16 are a motor, a pump, a heater, and the like. FIG. 5 illustrates a pickup motor 168A that drives the pickup roller 163A and an actuator 168B that moves the switching arm 163C as examples of the drive sections. In addition to the configuration in which the second drive section I/F 174 is directly coupled to a motor and an actuator, the second drive section I/F 174 may be couple to a drive circuit or a drive IC that supplies a drive current under the control of the second controller 170. The second controller 170 operates each drive section including the pickup motor 168A and the actuator 168B via the second drive section I/F 174.

1.7 Operation of Sheet Manufacturing System

Figure 6:
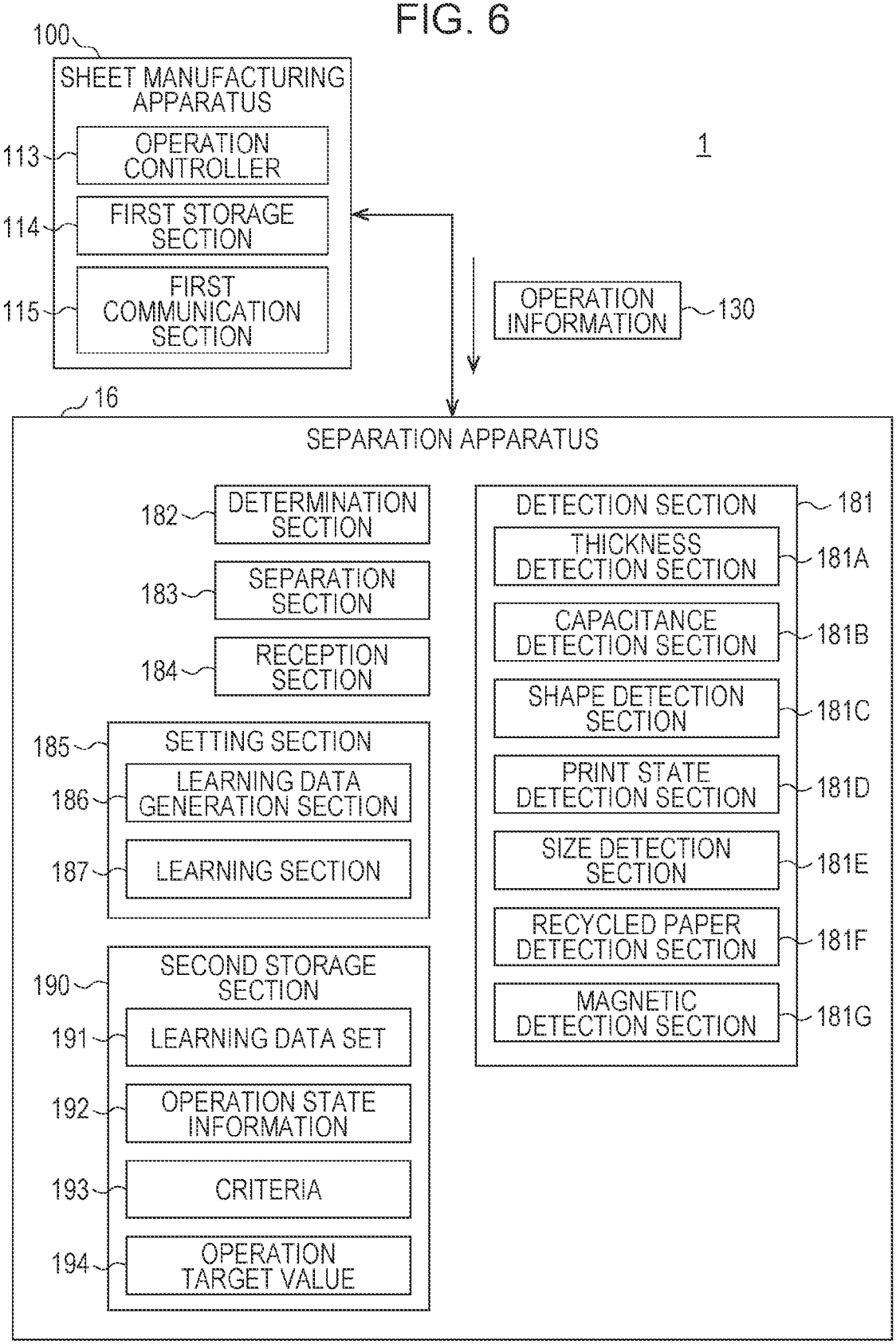
FIG. 6 is a functional block diagram of the sheet manufacturing system.

FIG. 6 is a functional block diagram of the sheet manufacturing system 1. FIG. 6 also illustrates the information transmitted from the sheet manufacturing apparatus 100 to the separation apparatus 16.

The sheet manufacturing apparatus 100 includes an operation controller 113, a first storage section 114, and a first communication section 115 as the functional sections of the first controller 110. Each of these sections is realized in combination of hardware and software by the first processor 111 executing a program. The first storage section 114 is configured by using the first memory 112 or a storage area of the nonvolatile memory 120. The first communication section 115 is realized by the first processor 111 controlling the first communication I/F 125.

The operation controller 113 operates each section of the sheet manufacturing apparatus 100 to produce the sheets S. The operation controller 113 obtains the detection value of each sensor in the process of manufacturing the sheet S, monitors the operation state of the processing section 101, and detects an operation hindrance of the processing section 101.

The operation hindrance detected by the operation controller 113 includes paper clogging of the raw materials MA in each section including the coarse crushing section 12, which is a so-called paper feed jam. Also, the operation hindrance includes stagnation of the raw materials MA, the defibrated materials MB, and the mixture MX. Also, the operation hindrance includes a defective shape of the second web W2. The defective shape of the second web W2 is torn-off of the second web W2, short thickness, getting a hole, or the like. Also, the operation hindrance includes a defective shape of the heated sheet SS2. The defective shape of the heated sheet SS2 includes deviation of whiteness of the heated sheet SS2 from a reference range, deviation of stiffness of the heated sheet SS2 from a reference range, and the like.

The operation controller 113 detects a paper feed jam in the coarse crushing section 12 based on a detection result of the drive section monitor 217. The operation controller 113 obtains detection results of the stagnation sensors 211, 212, and 213, and detects stagnation of the raw materials MA, the defibrated materials MB, and the mixture MX based on the detection results. The operation controller 113 obtains a detection result of the web state detection section 214, and detects a defective shape of the second web W2 based on the obtained detection result. The operation controller 113 obtains a detection result of the sheet state detection section 215, and detects a defective shape of the heated sheet SS2 based on the obtained detection result.

When the operation controller 113 determines that there is an operation hindrance, the operation controller 113 generates operation information 130. The operation information 130 includes the information indicating the type of the operation hindrance that has occurred. The operation controller 113 stores the operation information 130 in the first storage section 114. The operation controller 113 transmits the operation information 130 stored in the first storage section 114 to the separation apparatus 16 by the first communication section 115 every time the operation controller 113 generates the operation information 130, or at preset intervals. The first communication section 115 corresponds to an example of the transmission section.

The separation apparatus 16 includes a detection section 181, a determination section 182, a separation section 183, a reception section 184, a setting section 185, and a second storage section 190 as functional sections configured by the second controller 170. Each of these sections is realized in combination of hardware and software by the second processor 171 executing a program. The second memory 190 is configured by using a storage area of the second memory 172. The reception section 184 is configured by the second processor 171 controlling the second communication I/F 175.

The second storage section 190 stores a learning data set 191, operation state information 192, criteria 193, and an operation target value 194. The criteria 193 include a reference for the determination section 182 to determine whether the raw materials MA are suitable. That is to say, the criteria 193 are criteria set in the separation apparatus 16. The operation target value 194 includes a target value to be achieved as the operation state of the processing section 101. A description will be given later of the learning data set 191 and the operation state information 192.

The detection section 181 includes a thickness detection section 181A, a capacitance detection section 181B, a shape detection section 181C, a print state detection section 181D, a size detection section 181E, a recycled paper detection section 181F, and a magnetic detection section 181G.

The thickness detection section 181A detects the thickness of the raw materials MA based on the detection value of the displacement meter 165A. The capacitance detection section 181B detects the capacitance of the raw materials MA based on the detection result of the capacitance sensor 165B. The shape detection section 181C analyzes the image data output by the image sensor 165C and extracts the shape of the raw materials MA. The shape detection section 181C analyzes the extracted shape of the raw materials MA and detects a loss of the raw materials MA. The shape detection section 181C may calculate, for example, a degree of loss indicating the number of losses and sizes of the losses of the raw materials MA. The print state detection section 181D analyzes the image data output by the image sensor 165C and calculates the print duty of the front surface and/or the back surface of the raw materials MA. The size detection section 181E analyzes the image data output by the image sensor 165C and calculates the size of the raw materials MA.

The recycled paper detection section 181F obtains a recycle generation when the raw materials MA are identified as recycled paper based on the detection result of the spectroscopy detector 165D. The generation of recycled paper refers to the number of times of performing recycling paper produced from pulp by the sheet manufacturing apparatus 100 with new paper as a reference. For example, the sheet S produced by the sheet manufacturing apparatus 100 using new paper as the raw materials MA is referred to as a first generation, which is the recycled paper produced by recycling once. The sheet S produced by the sheet manufacturing apparatus 100 using the first generation sheet S as the raw materials MA is a second generation. After this, when the raw material MA of the sheet manufacturing apparatus 100 are identified as recycled paper, the sheet S produced by the sheet manufacturing apparatus 100 becomes the recycled paper of one generation later from the raw materials MA. When the generation of recycled paper proceeds, there is a tendency that the length of fibers included in paper becomes short due to the influence of defibrating mainly by the defibrating section 20. Also, when the generation of the recycled paper proceeds, the rate of additive materials AD added by the additive supply section 52 to the loading material included in new paper increases. The changes of these generations affects the quality of the sheet produced by the sheet manufacturing apparatus 100. Accordingly, the sheet manufacturing system 1 detects the generation of the recycled paper as the state of the raw materials MA by the recycled paper detection section 181F and uses for a determination as described later.

The magnetic detection section 181G detects, based on the detection result of the near magnetic field sensor 165E, whether adhesion or inclusion of metal is present, or the amount of metal in the raw materials MA. The thickness detection section 181A, the capacitance detection section 181B, the shape detection section 181C, the print state detection section 181D, the size detection section 181E, the recycled paper detection section 181F, and the magnetic detection section 181G correspond to examples of the first detection section and the second detection section. In other words, the first detection section and the second detection section are individually selected from each section of the detection section 181. The first detection section and the second detection section may include each sensor in the raw material inspection section 165 used by a corresponding section in the detection section 181 with each corresponding section in the detection section 181. It is possible to say that each of these sensors is an example of the first detection section and the second detection section.

The determination section 182 determines whether the raw materials MA are suitable for the processing by the processing section 101, that is to say, determines suitability of the raw materials MA. The raw materials MA suitable for the processing by the processing section 101 refer to the raw materials MA having a low possibility of the occurrence of operation hindrances in the processing section 101. The raw materials MA unsuitable for the processing by the processing section 101 refer to the raw materials MA having a possibility of the occurrence of operation hindrances in the processing section 101.

For example, when the raw materials MA include extremely thick paper, it is difficult for the crushing blade 14 to crush the raw materials MA, and thus there is a concern that clogging of the raw materials MA might occur in the coarse crushing section 12. Also, there is a concern that the raw materials MA coarsely crushed by the coarse crushing section 12 are hard so that stagnation of the raw materials MA is likely to occur, and a lot of defibrated materials MB occur from one sheet of the raw materials MA so that stagnation of the defibrated material MB is likely to occur. Further, the transport of the defibrated materials MB becomes unstable, and thus there is a concern that the supply of the mixture MX to the drum section 61 becomes unstable. This state disrupts the stability of formation of the second web W2, and, for example, might cause the occurrence of torn off and a hole of the second web W2.

Also, for example, when the raw materials MA are easily charged with static electricity, the coarse crushed pieces of the raw materials MA, the defibrated material MB, and the mixture MX are easily charged with static electricity, there is a concern that stagnation might occur. The easiness of the raw materials MA being charged with static electricity depends on the ratio of the calcium carbonate, which is a loading material added at the time of manufacturing paper that becomes the raw materials MA, to the cellulose fibers. The index of the easiness of the raw materials MA being charged with static electricity includes a capacitance of the raw materials MA.

When the raw materials MA have a loss, such as a fold, a crease, a break, a punch hole, and the like, for example, when the raw materials MA have damage, deformation, unsuitable size, excessive thickness, attachment of a metal needle of a stapler, a paper clip, or the like, there is a concern that an operation hindrance of the processing section 101 might occur. Paper having a loss or deformation refers to paper specifically having a crease, a break, dirt, a shape that is too bended to be apparently different from the other raw materials MA, and the like. Paper having an unsuitable size is specifically paper having a size deviated from the range of the size of the raw materials MA that are able to be processed by the sheet manufacturing apparatus 100. These kinds of paper is not suitable for the processing, because there is a possibility that clogging might occur from the separation apparatus 16 to the coarse crushing section 12, or in the transport path after that. Excessive thick paper and paper stuck to other paper are hard, and thus there is a possibility of causing a hindrance in the operation of the coarse crushing section 12 and the defibrating section 20. Also this paper generates a lot of defibrated materials MB by being defibrated by the defibrating section 20, and thus there is a possibility of causing clogging of the defibrated materials MB.

Accordingly, the paper is not suitable for the processing. The paper to which a metal needle of a stapler or a paper clip is attached is not suitable for the processing, because the metal needle or the paper clip has a possibility of giving impact on the operation of the coarse crushing section 12 and the defibrating section 20.

The determination section 182 determines, based on the state of the raw materials MA detected by the detection section 181, whether the raw materials MA are suitable regarding a plurality of items that affect the rate of occurrence of operation hindrances in the processing section 101. The determination section 182 makes a determination by comparing a detection result of the thickness detection section 181A with a criterion value set regarding the thickness of the raw materials MA. The determination section 182 makes a determination by comparing a detection result of the capacitance detection section 181B with a criterion value set regarding the capacitance of the raw materials MA. The determination section 182 makes a determination by comparing a detection result of the shape detection section 181C with a criterion value set regarding the loss of the raw materials MA. The determination section 182 makes a determination by comparing a detection result of the print state detection section 181D with a criterion value set regarding the print duty. The determination section 182 makes a determination by comparing a detection result of the size detection section 181E with a criterion value set regarding the size of the raw materials MA. The determination section 182 makes a determination by comparing a detection result of the recycled paper detection section 181F with a criterion value set regarding the recycle generation. The determination section 182 makes a determination by comparing a detection result of the magnetic detection section 181G with a criterion value set regarding whether metal is present in the raw materials MA or the amount of metal in the raw materials MA. The criteria values used by the determination section 182 are stored in the second storage section 190 as the criteria 193. The criteria 193 include a criterion value of each item.

The determination section 182 makes a determination regarding each item of thickness of the raw materials MA, capacitance, loss, print duty, size, recycle generation, and whether metal is present or the amount of metal. Further, the determination section 182 makes a determination on the suitability of the raw materials MA by integrating the determination result of each item. Here, an item on which the raw materials MA are determined as unsuitable for the processing is referred to as a negative item for convenience. For example, the determination section 182 determines, based on the number of negative items, whether the raw materials MA are suitable for the processing performed by the processing section 101. Specifically, when the number of negative items exceeds a number specified by the criteria 193, the determination section 182 determines that the raw materials MA are unsuitable for the processing performed by the processing section 101.

Also, when the negative items include an item specified by the criteria 193, the determination section 182 determines that the raw materials MA are unsuitable for the processing performed by the processing section 101. For example, when presence/absence of metal or the amount of metal is included in the negative items, the determination section 182 determines that the raw materials MA are unsuitable for the processing performed by the processing section 101. In this manner, the determination section 182 may determine, based on the number of negative items and the types of the negative items or the other references, whether the raw materials MA are suitable.

The separation section 183 operates the actuator 168B so as to switch, based on a determination result of the determination section 182, the transport path of the raw materials MA between the route to the collection tray 166 and the route to sheet manufacturing apparatus 100 to separate the raw materials MA. Specifically, when the determination section 182 determines that the raw materials MA are unsuitable for the processing performed by the processing section 101, the separation section 183 moves the switching arm 163C to the separation position 163E so as to collect the raw materials MA in the collection tray 166. When the determination section 182 determines that the raw materials MA are suitable for the processing performed by the processing section 101, the separation section 183 moves the switching arm 163C to the supply position 163D so as to transport the raw materials MA to the coarse crushing section 12. The reception section 184 receives the operation information 130 transmitted by the sheet manufacturing apparatus 100. The reception section 184 corresponds to an example of the acquisition section.

The setting section 185 includes a learning data generation section 186 and a learning section 187. The learning data generation section 186 generates or updates the operation state information 192 based on the operation information 130. The operation state information 192 is information indicating the occurrence state of operation hindrances that have occurred in the sheet manufacturing apparatus 100 for each type of the operation hindrances. For example, the operation state information 192 includes the rate of occurrence of operation hindrances for each type of operation hindrances. The operation state information 192 may include the rate of occurrence of operation hindrances produced by integrating a plurality of types of operation hindrances. The learning data generation section 186 may, for example, add the operation information 130 regarding all the operation hindrances so as to calculate the rate of occurrence of any one of the operation hindrances to determine it as the operation state information 192.

The rate of occurrence of operation hindrances refers to, for example, the number of occurrences of operation hindrances per operation time of the sheet manufacturing apparatus 100, that is to say, per operation time for manufacturing the sheets S. The rate of occurrence of operation hindrances may be the number of occurrences of operation hindrances during which the sheet manufacturing apparatus 100 produce the unit number of pieces of the sheet S. The rate of occurrence of operation hindrances may be the number of occurrences of operation hindrances during which the sheet manufacturing apparatus 100 processes the unit number of pieces of the raw materials MA.

The learning data generation section 186 generates or updates the learning data set 191 based on the operation state information 192 and the criteria 193. The learning data set 191 includes the criteria 193 including a determination reference value set in the separation apparatus 16 and the operation state information 192 regarding the operation hindrances that have occurred in the sheet manufacturing apparatus 100 while the criteria 193 is set in association with each other.

The learning section 187 learns, based on the learning data set 191, correlation between the rate of occurrence of operation hindrances and a criterion of each item of the determination section 182. In the present embodiment, the learning section 187 includes a learning model that performs machine learning. The learning section 187 performs learning by using the learning data set 191 so as to form a learning model for obtaining a criterion of each item of the determination section 182 from the rate of occurrence of operation hindrances. The learning model is an algorithm model, a statistical model, a mathematical model, or the like included in artificial intelligence, and may include a neural network structure. Artificial intelligence is also referred to as AI. AI is an abbreviation of artificial intelligence.

Specific mode of learning performed by the learning section 187 is not limited in particular. For example, the learning section 187 may perform so-called unsupervised machine learning on the correlation between the rate of occurrence of operation hindrances included in the learning data set 191 and the criterion of each item. Also, the learning section 187 may perform semi-supervised learning, or may perform so-called transfer learning by using a trained learning model. Also, the learning section 187 may conduct, for example, multiple regression analysis by using the rate of occurrence of operation hindrances included in the learning data set 191 as the objective variable and a criterion of each item as the explanatory variable. The learning section 187 may perform deep learning.

When the rate of occurrence of operation hindrances of the processing section 101 is given, it becomes possible for the learning section 187 to estimate a reference value of each item for realizing the given rate of occurrence by using a trained learning model. That is to say, it is possible for the learning section 187 to estimate the criterion of the determination section 182 so that the rate of occurrence of operation hindrances in the processing section 101 becomes the operation target value 194. It is desirable that the operation target value 194 include a target value for achieving the operation state of the processing section 101, and that, for example, the rate of occurrence of operation hindrances in the processing section 101 be kept less than or equal to the operation target value 194. The operation target value 194 is a value set for each model of the sheet manufacturing apparatus 100 or a preset value for each apparatus.

The learning data generation section 186 may compare the rate of occurrence of operation hindrances indicated by the operation state information 192 with the operation target value 194, determine whether the rate of occurrence of operation hindrances obtained from the operation information 130 is in a suitable range, and generate learning data set 191 including the determination result. The learning data set 191 becomes data that associates a reference value of each item indicated by the criteria 193 with a label indicating whether the rate of occurrence of operation hindrances in the processing section 101 is suitable. In this case, the learning section 187 may perform supervised machine learning by using the learning data set 191 including the label.

Also, the learning section 187 may perform reinforcement learning on the learning model. Specifically, the learning data generation section 186 compares the rate of occurrence of operation hindrances indicated by the operation state information 192 with the operation target value 194 to determine whether the rate of occurrence of operation hindrances obtained from the operation information 130 is in a suitable range. The learning data generation section 186 may generate a learning data set 191 including a reward on which a determination result has been reflected, and cause the learning section 187 to perform reinforcement learning based on the learning data set 191. In this case, the learning section 187 causes the learning model to perform reinforcement learning so as to become possible to estimate a reference value with higher accuracy. The learning model that performs reinforcement learning may be an initial model before learning or a trained model that has learned by using the learning data set 191. Also, the learning section 187 may include a trained model that has learned by using a learning data set not based on the operation state information 192 and cause the trained model to learn by using learning data set 191. For example, the learning section 187 may generate a trained model by using a learning data set for initial learning, which has been generated from the operation record generated by another apparatus of the same model with that of the sheet manufacturing apparatus 100. Also, a trained model that has learned by using a learning data set for initial learning may be implemented in the second controller 170 at the time of producing the separation apparatus 16.

Figure 7:
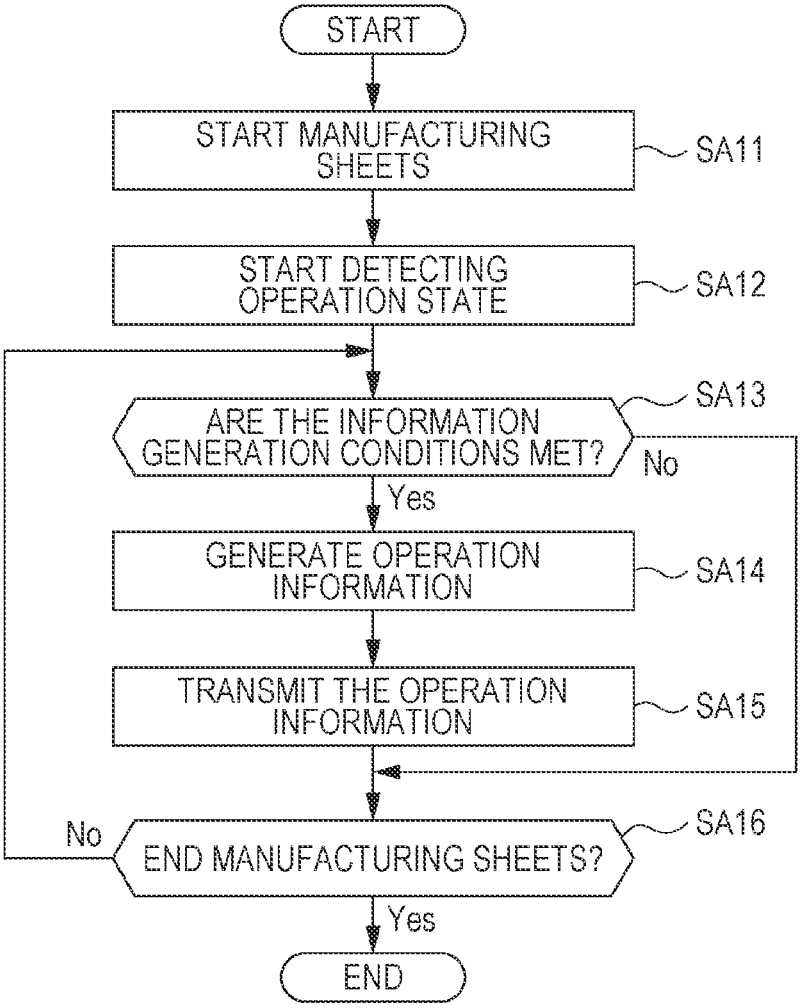
FIG. 7 is a flowchart illustrating the operation of the sheet manufacturing apparatus.

FIG. 7 is a flowchart that illustrates the operation of the sheet manufacturing apparatus 100, and particularly illustrates the processing for generating the operation information 130 in the operation to produce the sheet S. The operation illustrated in FIG. 7 is performed by the first controller 110.

The first controller 110 controls each drive section of the sheet manufacturing apparatus 100 to start producing the sheet S (step SA11). At this time, although not illustrated in FIG. 7, the separation apparatus 16 supplies the raw materials MA to the sheet manufacturing 100.

The first controller 110 starts detecting the operation state of the processing section 101 (step SA12). Specifically, the first controller 110 starts detecting an operation hindrance in the processing section 101. Here, as described above, an operation hindrance includes at least one of a paper feed jam in the coarse crushing section 12, stagnation of the raw materials MA, the defibrated materials MB, and the mixture MX, a defective shape of the second web W2, and a defective shape of the heated sheet SS2.

The first controller 110 determines whether the information generation condition, which is set in advance as a condition for generating the operation information 130, is met (step SA13). In the present embodiment, as described above, when an operation hindrance occurs in the sheet manufacturing apparatus 100, operation information 130 is generated. Accordingly, the information generation condition is the occurrence of any one of the operation hindrances. The operation of the first controller 110 is not limited to this example. For example, the operation information 130 may be generated at preset time intervals during the operation of producing the sheet S, that is to say, during the operation of the sheet manufacturing apparatus 100. In this case, the information generation condition is the lapse of set time during the operation of the sheet manufacturing apparatus 100.

When the information generation condition is not met (step SA13; NO), the processing of the first controller 110 proceeds to step SA16 described later. When the information generation condition is met (step SA13; YES), the first controller 110 generates operation information 130 (step SA14), transmits the operation information 130 to the separation apparatus 16 (step SA15), and the processing proceeds to step SA16.

In step SA16, the first controller 110 determines whether to end producing the sheets S (step SA16). When a production stop is instructed by the operation of the touch sensor 124, or when the production of the specified number of sheets S is completed, the first controller 110 make an affirmative determination in step SA16 (step SA16; YES). In this case, the first controller 110, for example, executes a stop sequence of the sheet manufacturing apparatus 100 to end this processing. When the production of the sheets S is not ended (step SA16; NO), the processing of the first controller 110 returns to step SA13.

Figure 8:
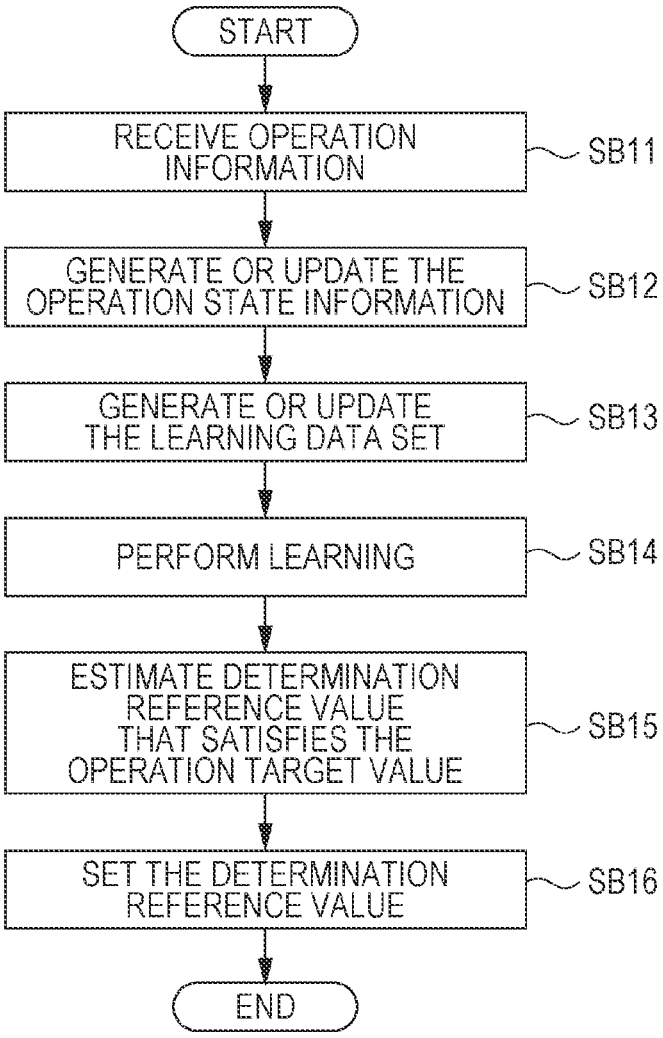
FIG. 8 is a flowchart illustrating the operation of the separation apparatus.

FIG. 8 is a flowchart illustrating the operation of the separation apparatus 16. In particular, FIG. 8 illustrates the operation regarding learning using the operation information 130. The operation illustrated in FIG. 8 is performed by the second controller 170. The second controller 170 receives the operation information 130 (step SB11), and generates or updates the operation state information 192 based on the received operation information 130 (step SB12). The second controller 170 generates or updates the learning data set 191 based on the operation state information 192 generated or updated in step SB12 and the determination reference 193 (step SB13).

The second controller 170 causes the learning section 187 to perform learning by using the learning data set 191 (step SB14). The second controller 170 estimates a determination reference value that satisfies the operation target value 194, which is the target of the operation state of the processing section 101, by the learning section 187 after learning (step SB15). The second controller 170 updates the criteria 193 by including the estimated reference value in the criteria 193 so as to set a new reference value (step SB16).

1.8 Operational Advantages of Embodiment

As described above, the sheet manufacturing system 1 according to the first embodiment includes the processing section 101 that processes the raw materials MA including fibers and the detection section 181 that detects the state of the raw materials MA. The sheet manufacturing system 1 includes the determination section 182 that determines, based on a detection result of the detection section 181 and preset criteria of the state of the raw materials MA, whether the raw materials MA are suitable for the processing performed by the processing section 101. The sheet manufacturing system 1 includes the transport section 163 as the supply section that supplies, to the processing section 101, the raw materials MA determined as suitable for the processing by the determination section 182. The sheet manufacturing system 1 includes the reception section 184 as the acquisition section that obtains the operation information 130 indicating the occurrence state of operation hindrances in the processing section 101, and the setting section 185 that sets criteria based on the operation information 130.

In the fiber processing method performed by the sheet manufacturing system 1, the state of the raw materials MA is detected, and a determination is made, based on a result of the state of the raw materials MA and preset criteria of the state of the raw materials MA, as to whether the raw materials MA are suitable for the processing performed by the processing section 101. The raw materials MA determined as suitable for the processing are supplied to the processing section 101 that performs the processing, the operation information 130 indicating the occurrence state of operation hindrances in the processing section 101 is obtained, and the criteria are set based on the operation information 130.

With the sheet manufacturing system 1 to which the disclosure is applied and the fiber processing method performed by the sheet manufacturing system 1, it is possible to set a reference for distinguishing the raw materials MA suitable for the processing performed by the processing section 101 from the unsuitable raw materials MA in accordance with the state of the operation of the processing section 101. Thereby, it is possible to determine, based on a suitable reference, whether the raw materials MA are suitable for recycling performed by the sheet manufacturing apparatus 100, and to separate the unsuitable raw materials MA for recycling. Accordingly, it is possible to suppress the operation hindrance of the sheet manufacturing apparatus 100, which is caused, for example, by using unsuitable raw materials MA. Also, it is possible to reduce the raw materials MA to be discarded by reason that the raw materials MA are determined as unsuitable for the processing performed by the processing section 101.

The setting section 185 includes the learning data generation section 186 that generates the earning data set 191 including the criteria and the operation information 130 in association with each other, and a learning section 187 that learns, based on the learning data set 191, the correlation between the criteria and the operation information 130. The setting section 185 sets the criteria so that the operation information 130 satisfies the operation target value 194. Thereby, it is possible to operate the sheet manufacturing apparatus 100 so as to determine based on the suitable criteria and to satisfy the operation target value 194. As described above, the operation hindrances of the processing section 101 include various phenomena, such as clogging, stagnation of the raw materials MA, a defective shape of the second web W2 and the heated sheet SS2, and the like. The causes of these operation hindrances are various, and the correlation of the state of the raw materials MA and the operation hindrances in the processing section 101 is complicated. Accordingly, when the operation hindrances in the processing section 101 are suppressed, it is desirable that suitable criteria regarding the state of the raw materials MA be set. However, it is not easy for an operator to set suitable criteria. Further, for example, it is difficult for the operator to set a suitable criterion for each of a plurality of items regarding the state of the raw materials MA. In the sheet manufacturing system 1, the learning section 187 is caused to perform learning based on the learning data set 191 generated by the learning data generation section 186, and the determination reference values are set by using the trained learning section 187. Accordingly, it is possible for the second controller 170 to set a suitable criterion for each of the plurality of items regarding the state of the raw materials MA.

The detection section 181 includes the first detection section and the second detection section, and the determination section 182 make a determination based on the criterion corresponding to a detection value of the first detection section and the criterion corresponding to a detection value of the second detection section. With this configuration, a determination is made for each of the detection results of a plurality of detection sections included in the detection section 181 by using the criteria set by the setting section 185. Accordingly, it is possible to determine whether the raw materials MA are suitable for the processing performed by the processing section 101 with high accuracy.

The first detection section and the second detection section include any one of the thickness detection section 181A, the capacitance detection section 181B, the shape detection section 181C, the print state detection section 181D, the size detection section 181E, and the recycled paper detection section 181F. The thickness detection section 181A detects the thickness of the sheet-like raw materials MA. The capacitance detection section 181B detects the capacitance of the raw materials MA. The shape detection section 181C detects the degree of end loss of the raw materials MA which are standard sheets. The print state detection section 181D detects the print duty of the raw materials MA which are printed matters. The recycled paper detection section 181F detects the recycle generation of the raw materials MA which are produced from recycled paper. The size detection section 181E detects the size of the raw materials MA. With this configuration, it is possible to determine whether the raw materials MA are suitable by using a plurality of items out of the thickness, capacitance, shape loss, print duty, recycle generation, and size as indexes regarding the state of the raw materials MA. Also, it is possible to set suitable criteria corresponding to the plurality of items respectively. Accordingly, it is possible to determine whether the raw materials MA are suitable with high accuracy.

The learning data generation section 186 generates the learning data set 191 including the information obtained from the operation state information 192 and the criteria of a plurality of items included in the criteria 193 in association with each other. That is to say, the learning data set 191 includes a criterion corresponding to the detection value of the first detection section and a criterion corresponding to the detection value of the second detection section, and the information of the operation state information 192 in association with each other. Accordingly, it is possible to reflect the configuration of the detection section 181 on the learning performed by the learning section 187 in detail, and thus it is possible to estimate the criteria by using the trained learning section 187 with high accuracy.

The processing section 101 includes the coarse crushing section 12 that crushes the raw materials MA, the defibrating section 20 that defibrates the raw materials MA cut by the cutting section, and the forming section 102 that forms the defibrated materials defibrated by the defibrating section to produce the sheet S. The reception section 184 obtains the operation information 130 indicating the occurrence state of at least any one of clogging of the raw materials MA in the processing section 101, stagnation of the raw materials MA crushed by the coarse crushing section 12, and a defective shape of the second wave W2 and the sheet S produced by the forming section 102. With this configuration, it is possible to set the criteria that enable suppression of the rate of occurrence of operation hindrances in accordance with a plurality of operation hindrances that occur in the processing section 101. Accordingly, it is possible to improve the operation efficiency of the sheet manufacturing apparatus 100.

The sheet manufacturing system 1 includes the separation apparatus 16 that separates the raw materials MA and the sheet manufacturing apparatus 100 that processes the raw materials MA separated by the separation apparatus 16 by using the processing section 101. The sheet manufacturing apparatus 100 includes the processing section 101 and the first controller 110. The first controller 110 includes the operation controller 113 that detects the operation of the processing section 101 and generates the operation information 130, and the first communication section 115 that transmits the operation information 130 to the separation apparatus 16. The separation apparatus 16 includes the separation section 183 that separates the raw materials MA determined as suitable for the processing by the determination section 182 from the raw materials MA determined as unsuitable for the processing. The separation apparatus 16 includes the detection section 181, the determination section 182, and the reception section 184 that receives the operation information 130 as the acquisition section, and the setting section 185. With this configuration, which includes the sheet manufacturing apparatus 100 and the separation apparatus 16, the operation information 130 indicating the operation state of the sheet manufacturing apparatus 100 is transmitted to the separation apparatus 16, and the separation apparatus 16 sets the criteria based on the operation information 130.

Accordingly, in the configuration in which the separation apparatus 16 determines and separates the raw materials MA, it is possible to suitably set the criteria by reflecting the state of the operation of the sheet manufacturing apparatus 100. Also, the raw materials MA separated by the separation apparatus 16 are supplied to the sheet manufacturing apparatus 100, and thus it is not necessary for the sheet manufacturing apparatus 100 to include a component for separating the raw materials MA. Accordingly, it is possible to miniaturize the sheet manufacturing apparatus 100.

2. SECOND EMBODIMENT

Figure 9:
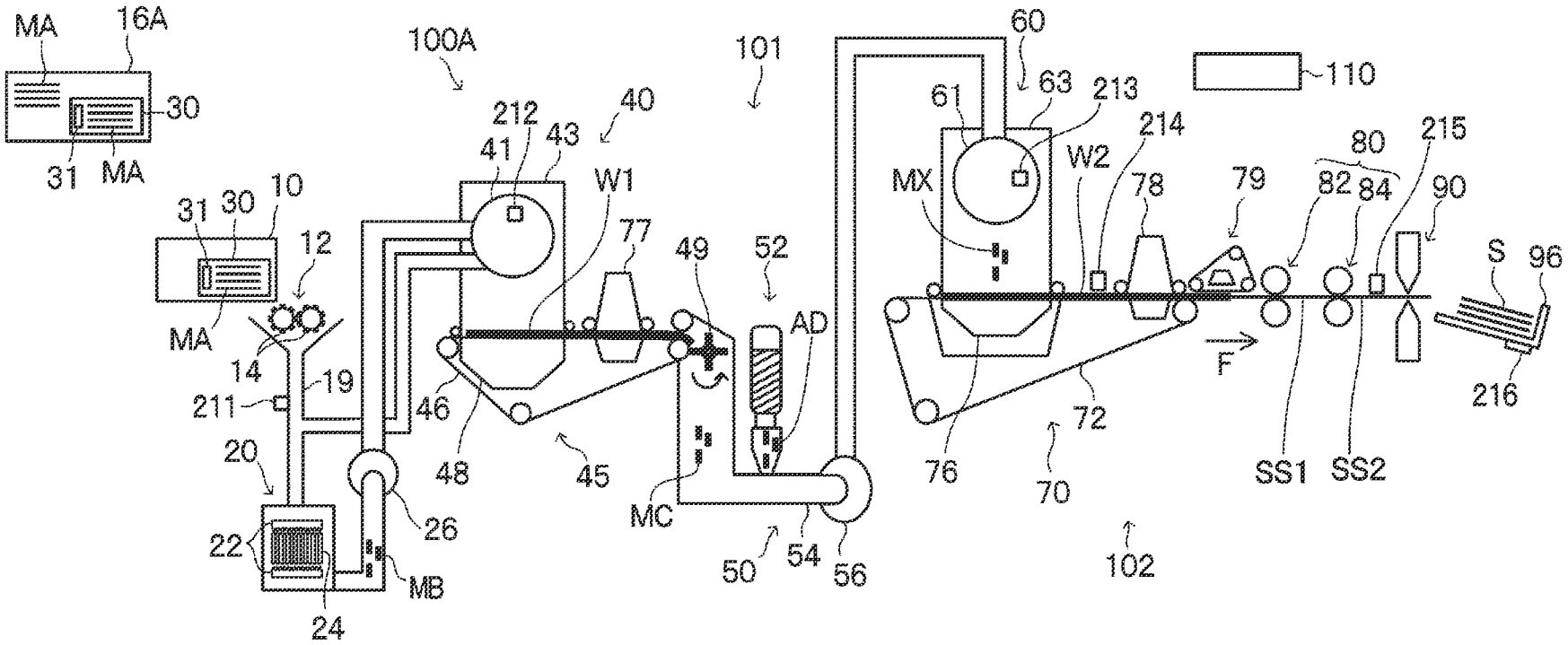
FIG. 9 is a diagram illustrating the schematic configuration of a sheet manufacturing system according to a second embodiment.
Figure 10:
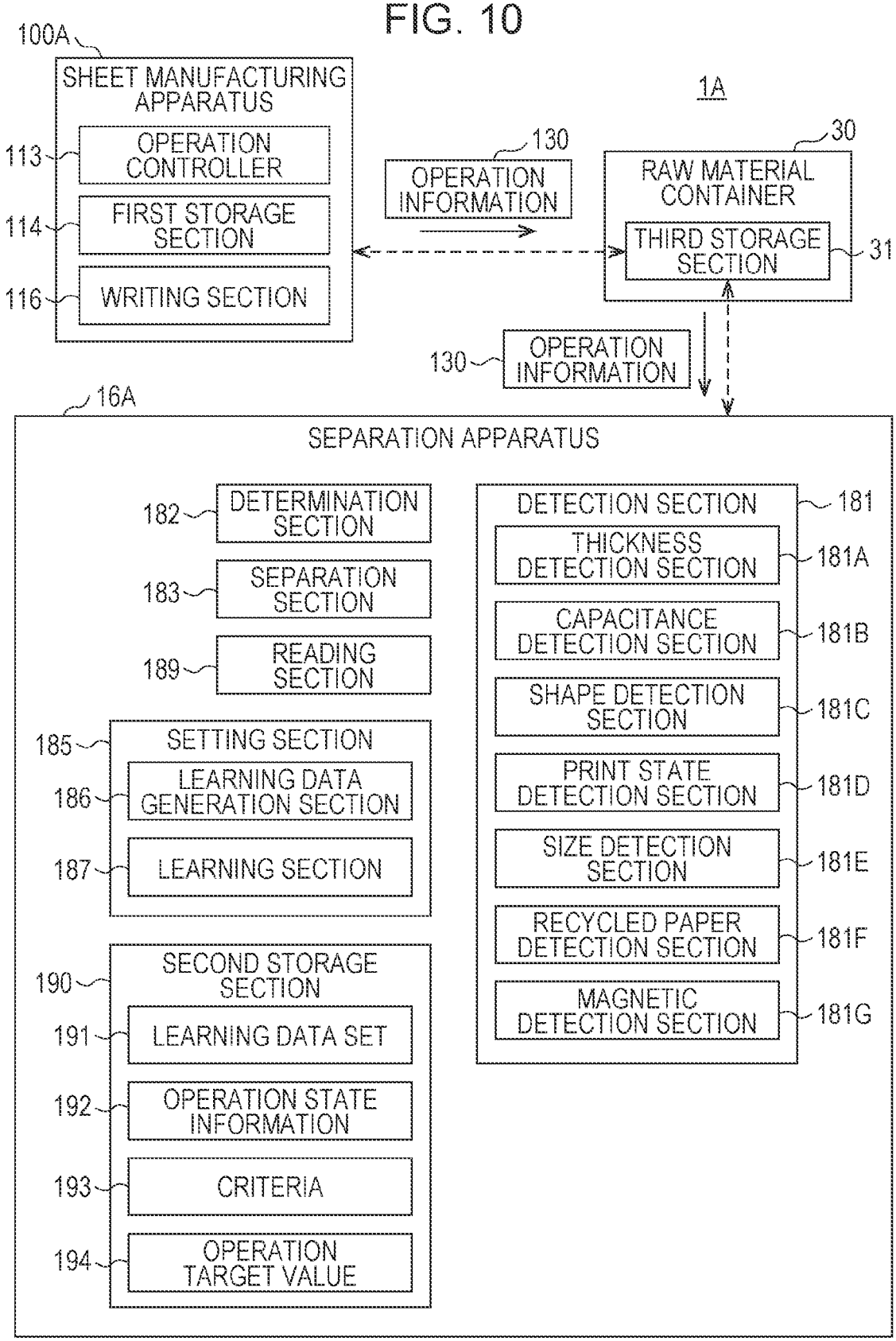
FIG. 10 is a functional block diagram of the sheet manufacturing system according to the second embodiment.

FIG. 9 is a diagram illustrating the configuration of a sheet manufacturing system 1A according to a second embodiment of the present disclosure. FIG. 10 is a functional block diagram of the sheet manufacturing system 1A. In the diagrams and the descriptions according to the second embodiment, a same sign is given to a component common to that of the first embodiment, and the description will be omitted.

The sheet manufacturing system 1A includes a sheet manufacturing apparatus 100A and a separation apparatus 16A. The separation apparatus 16A is disposed dividedly from the sheet manufacturing apparatus 100A. The separation apparatus 16 described in the first embodiment has a function of supplying the raw materials MA to the coarse crushing section 12. However, the separation apparatus 16A does not directly supply the raw materials MA to the coarse crushing section 12. Instead of this, the separation apparatus 16A determines the raw materials MA, and when the separation apparatus 16A accommodates the raw materials MA determined as suitable for the processing performed by the processing section 101 in a raw material container 30. The sheet manufacturing system 1A corresponds to an example of the fiber processing system. The sheet manufacturing apparatus 100A corresponds to an example of the processing apparatus.

The raw material container 30 is a container like a cartridge that is movable, for example, by a user's hand in the state containing the raw materials. The raw material container 30 is removable from the separation apparatus 16A and the sheet manufacturing apparatus 100A. In the state in which the raw material container 30 is attached, the separation apparatus 16A transports the raw materials MA to the raw material container 30 by the transport section 163. Thereby, the raw materials MA determined by the separation apparatus 16A as suitable for the processing performed by the processing section 101 are accommodated in the raw material container 30.

The sheet manufacturing apparatus 100A has a supply section 10 to which the raw material container 30 is attachable. The supply section 10 picks up the raw materials MA accommodated in the raw material container 30 one sheet by one sheet or a predetermined number of sheets, and supplies the raw materials MA to the coarse crushing section 12. The processing section 101 including the coarse crushing section 12 is common to the first embodiment.

A third storage section 31 is attached to the raw material container 30. The third storage section 31 has a storage area that is able to store data in a nonvolatile manner. It is possible to configure the third storage section 31, for example, by a semiconductor memory device, such as a flash ROM, or the like, a magnetic storage device, or a wireless IC tag. It is possible to say that the third storage section 31 is a storage section on the container, and the third storage section 31 corresponds to an example of the storage section.

It is possible for the sheet manufacturing apparatus 100A to write data in the third storage section 31. For example, the supply section 10 includes a write circuit not illustrated in the figure and coupled to the third storage section 31 or an interface circuit not illustrated in the figure and configured to write data in the third storage section 31 in a non-contact manner. On the other hand, it is possible for the separation apparatus 16A to read the data written in the third storage section 31. For example, the separation apparatus 16A includes a read circuit not illustrated in the figure and coupled to the third storage section 31 or an interface circuit not illustrated in the figure and configured to read data from the third storage section 31 in a non-contact manner.

As illustrated in FIG. 10, the sheet manufacturing apparatus 100A includes a writing section 116 in addition to the operation controller 113 and the first storage section 114. The writing section 116 writes the operation information 130 generated by the operation controller 113 to the third storage section 31. The writing section 116 includes the function of the second controller 170.

The separation apparatus 16A includes a reading section 189. The reading section 189 reads the operation information 130 from the third storage section 31 included in the raw material container 30 set in the separation apparatus 16A. The learning data generation section 186 generates operation state information 192 based on the operation information 130 read by the reading section 189 in the second storage section 190.

Figure 11:
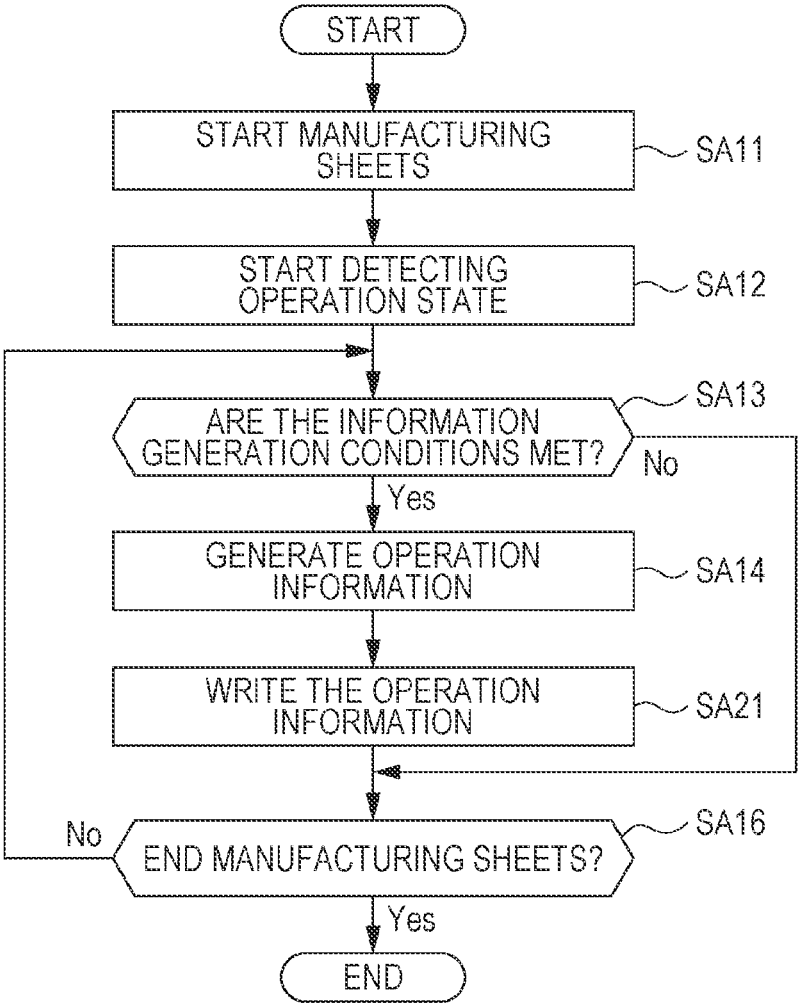
FIG. 11 is a flowchart illustrating the operation of a sheet manufacturing apparatus according to the second embodiment.
Figure 12:
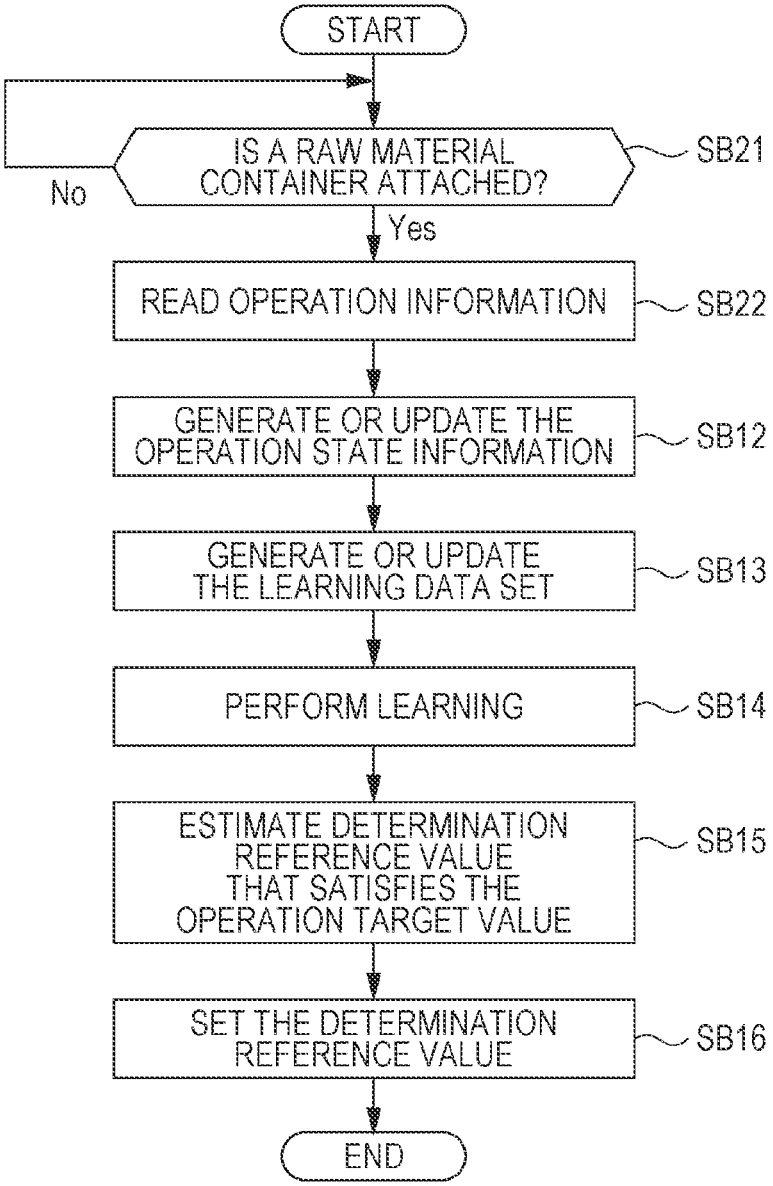
FIG. 12 is a flowchart illustrating the operation of a separation apparatus according to the second embodiment.

FIG. 11 is a flowchart illustrating the operation of the sheet manufacturing apparatus 100A. In particular, FIG. 11 illustrates the processing for generating the operation information 130 in the operation for producing the sheet S. The operation illustrated in FIG. 11 is performed by the first controller 110. In FIG. 11, the same step number is given to the processing common to that in FIG. 7, and the description will be omitted. FIG. 12 is a flowchart illustrating the operation of the separation apparatus 16. In particular, FIG. 12 illustrates the operation regarding learning using the operation information 130. The operation illustrated in FIG. 12 is performed by the second controller 170. In FIG. 12, the same step number is given to the processing common to that in FIG. 8 and the description will be omitted.

In producing the sheets S, the raw material container 30 containing the raw materials MA is set in the raw materials MA. Accordingly, when the first controller 110 performs the operation illustrated in FIG. 11, the raw material container 30 is set in the supply section 10.

The first controller 110 starts producing the sheets S (step SA11) and starts detecting the operation state of the processing section 101 (step SA12). After that, when the first controller 110 generates the operation information 130 (step SA14), the first controller 110 performs the processing for writing the operation information 130 in the third storage section 31 (step SA21), and the processing proceeds to step SA16.

When it is necessary to replenish the raw material container 30 with the raw materials MA, such as when the sheet manufacturing apparatus 100A uses up the raw materials MA contained in the raw material container 30, or the like, the raw material container 30 is set in the separation apparatus 16A.

The second controller 170 determines whether the raw material container 30 has been set (step SB21), and when the raw material container 30 has not been set (step SB21; NO), the processing waits until the raw material container 30 is set. When the raw material container 30 is set (step SB21; YES), the second controller 170 reads the operation information 130 from the third storage section 31 (step SB22). The second controller 170 generates or updates the operation state information 192 based on the operation information 130 read in step SB22 (step SB12).

In this manner, the sheet manufacturing system 1A according to the second embodiment of the present disclosure includes the separation apparatus 16A that separates the raw materials MA and accommodates in the raw material container 30, and the sheet manufacturing apparatus 100A takes out the raw materials MA from the raw material container 30 and causes the processing section 101 to perform processing on the raw materials MA. The sheet manufacturing apparatus 100A includes the processing section 101 and the operation controller 113 that detects the operation of the processing section 101 to generate the operation information 130. The first controller 110 stores the operation information 130 in the third storage section 31 disposed on the raw material container 30. The separation apparatus 16A includes the separation section 183 that separates the raw materials MA determined by the determination section 182 as suitable for the processing and the raw materials MA determined as unsuitable for the processing, the detection section 181, and the determination section 182. The separation apparatus 16A includes the reading section 189 as the acquisition section and the setting section 185. The reading section 189 obtains the operation information 130 from the third storage section 31 on the raw material container 30. With this configuration, it is possible to suitably set the criteria by which to determine whether the raw materials MA are suitable by reflecting the operation information 130 regarding the operation of the processing section 101. Accordingly, it is possible to efficiently determine, based on suitable criteria, whether the raw materials MA are suitable. Also, it is possible to obtain the similar effect as that of the sheet manufacturing system 1 according to the first embodiment.

Further, it is not necessary for the sheet manufacturing system 1A to physically dispose the separation apparatus 16A and the sheet manufacturing apparatus 100A in close proximity. Accordingly, the degree of freedom of the disposition of the sheet manufacturing system 1A increases, and thus it is possible to realize miniaturization of the sheet manufacturing apparatus 100A.

3. OTHER EMBODIMENTS

Each embodiment described above is only a specific mode in carrying out the present disclosure disclosed in the claims, and does not limit the present disclosure. It is possible to carry out the present disclosure in various modes, for example, as described in the following without departing from the spirit and scope of the disclosure.

For example, in each of the embodiments described above, the configuration is exemplified in which the detection section 181 includes the thickness detection section 181A, the capacitance detection section 181B, the shape detection section 181C, the print state detection section 181D, the size detection section 181E, the recycled paper detection section 181F, and the magnetic detection section 181G. The present disclosure is not limited to this. For example, it is possible to configure the detection section 181 by suitably selecting two or more detection sections from the individual detection sections described above. Also, the detection section 181 may be a detection section that detects an item other than the items described above as the state of the raw materials MA. For example, the detection section 181 may include a component that detect humidity of the raw materials MA by a humidity sensor, a component that detects whether an adhesive material adheres to the raw materials MA, a component that detects the gloss of the raw materials MA, the color of the raw materials MA, or the like based on the image data of the image sensor 165C.

In each of the embodiments described above, the learning section 187 may not perform the machine learning function and the multiple regression analysis. For example, the learning section 187 may increase or decrease the reference value for each item by a predetermined amount based on the determination result as to whether the rate of occurrence of operation hindrances obtained from the operation information 130 is in a suitable range. In this case, an item that increases or decreases the reference value ought to be set in association with the type of an operation hindrance, and a predetermined amount that increases or decreases the reference value ought to be set for each item. Also, the learning section 187 may perform PID control that feeds back the difference between the rate of occurrence of operation hindrances, which is obtained from the operation information 130, and the operation target value 194 to the reference value. PID is an abbreviation of proportional-integral-differential.

The separation apparatuses 16 and 16A are not limited to have the configuration in which the raw materials MA determined as unsuitable for the processing performed by the processing section 101 are collected by the collection amount sensor 167, and, for example, may be cut by a shredder.

Also, the separation apparatus 16 may include a storage section that temporarily stores the raw materials MA determined as suitable for the processing performed by the processing section 101 upstream of the coarse crushing section 12. In this case, the sheet manufacturing apparatus 100 may include a transport device that transports the raw materials MA stored in the storage section to the coarse crushing section 12.

Also, the operation information 130 may include date and time when the operation hindrance in the processing section 101 has been detected, or time information indicating a period of detection. In this case, the separation apparatuses 16 and 16A may compare the period of determination made by the criteria 193 and the time information of the operation information 130 so as to associate the criteria 193 and the operation information 130 to generate a learning data set 191.

There is no limit to the number of raw material containers 30 usable in the sheet manufacturing system 1A, and it is possible to use a plurality of raw material containers 30. In this case, for example, it is possible to store the raw materials MA suitable for the processing performed by the processing section 101 in one or a plurality of raw material containers 30. In this case, the pace of consuming the raw materials MA by the sheet manufacturing apparatus 100A is not restricted by the processing speed of the separation apparatus 16A.

Accordingly, even when the pace of consuming the raw materials MA by the sheet manufacturing apparatus 100A is faster than the pace of accommodating the raw materials MA in the raw material container 30 by the separation apparatus 16A, it is possible to produce the sheets S without a loss in the speed of the sheet manufacturing apparatus 100A.

Further, for example, the third storage section 31 may store identification information identifying the sheet manufacturing apparatus 100A that has generated the operation information 130 and the operation information 130 in association with each other. In this case, it is possible for a plurality of sheet manufacturing apparatuses 100A to use the raw material container 30 in common. Further, it is possible for the separation apparatus 16A to generate the learning data set 191 on which the rate of occurrence of operation hindrances in individual sheet manufacturing apparatuses 100A is reflected by the learning data generation section 186, and causes the learning section 187 to perform learning. Thereby, it is possible for the learning section 187 to estimate the reference value suitable for the processing section 101 included in each of the sheet manufacturing apparatuses 100A to generate the criteria 193. Accordingly, it is possible to determine the suitability of the raw materials MA based on the reference suitable for each of the processing sections 101. Also, in this case, the learning section 187 may have a learning model corresponding to each of the sheet manufacturing apparatuses 100A.

Each of the functional sections illustrated in FIG. 4 to FIG. 6, and FIG. 10 illustrates a functional configuration, and a specific implementation form is not particularly restricted. That is to say, it is not always necessary to implement hardware individually corresponding to each functional section. It is certainly possible for one processor to execute a program so as to realize the functions of a plurality of functional sections. Also, a part of the functions realized by software in the embodiments described above may be realized by hardware. Alternatively, a part of the functions realized by hardware may be realized by software. In addition, it is possible to change the specific detailed configuration of the other each section of the sheet manufacturing systems 1 and 1A in any way without departing from the spirit and scope of the disclosure.

The processing units in the flowcharts illustrated in FIG. 7, FIG. 8, FIG. 11, and FIG. 12 are produced by dividing the processing of each section in the sheet manufacturing systems 1 and 1A in accordance with the main processing contents to make it easy to understand. The processing units are not limited by the way of dividing the processing unit illustrated in these flowcharts and the name of the processing unit. It is possible to further divide the processing unit into a lot of processing units in accordance with the processing contents, and to make a division so that one processing unit includes further more processing. Also, the order of the processing in the flowcharts described above is not limited to the order of the processing illustrated in the examples illustrated in the figures.

Also, a program executed by each of the first controller 110 and the second controller 170 may be stored in each of the apparatuses. Alternatively, it is possible to record the program in a recording medium in a computer readable manner. It is possible to use a magnetic or optical recording medium, or a semiconductor memory device for the recording medium. Also, it is possible for a server device, or the like to store a program corresponding to each of the apparatuses described above, and to realize the operation of the sheet manufacturing systems 1 and 1A by downloading the program in each section from the server device.

What is claimed is:

1. A fiber processing system comprising:

a processing apparatus that includes a processing section configured to process a raw material, the raw material including a fiber, the processing section including a defibrating section that defibrates the raw material;

a processor wire or wirelessly connected to the processing apparatus, the processor constituting a detection section configured to detect a state of the raw material before the defibrating section defibrates the raw material, a determination section configured to determine, based on a preset criterion of a raw material state and based on a detection result of the state of the raw material by the detection section, whether the raw material is suitable or unsuitable for processing in the processing section, an acquisition section configured to acquire operation information, the operation information indicating an occurrence state of an operation hindrance in the processing section, and a setting section configured to set, based on the operation information, the preset criterion;

a separation apparatus including a separation section that separates raw material determined, by the determination section, to be suitable for processing from raw material determined, by the determination section, to be unsuitable for the processing; and a supply section disposed upstream relative to the processing apparatus in a transport direction of the raw material, the supply section being configured to be controlled by the processor to supply, to the processing section, the raw material that is determined to be suitable for the processing by the determination section.

2. The fiber processing system according to claim 1, wherein the setting section includes a learning data generation section that generates a learning data set, the learning data set includes the criterion and the operation information associated with the criterion; and a learning section that learns, based on the learning data set, correlation between the criterion and the operation information, and the criterion is set so that the operation information satisfies a preset condition.

3. The fiber processing system according to claim 2, wherein the detection section includes a first detection section and a second detection section, and the determination section performs determination based on the criterion corresponding to a detection value of the first detection section and the criterion corresponding to a detection value of the second detection section.

4. The fiber processing system according to claim 3, wherein the first detection section and the second detection section include one of a thickness detection section, a capacitance detection section, a shape detection section, a print state detection section, a recycled paper detection section, and a size detection section, the thickness detection section detects a thickness of the raw material in a sheet-like shape, the capacitance detection section detects a capacitance of the raw material, the shape detection section detects a degree of end loss of the raw material being a standard sheet, the print state detection section detects a print duty of the raw material being a printed matter, the recycled paper detection section detects a recycle generation of the raw material being recycled paper, and the size detection section detects a size of the raw material.

5. The fiber processing system according to claim 2, wherein the processing section further includes a cutting section that is disposed downstream relative to the supply section and upstream relative to the defibrating section in the transport direction of the raw material, the cutting section cuts the raw material, and a forming section that is disposed downstream relative to the defibrating section in the transport direction of the raw material, the forming section forms a defibrated material defibrated by the defibrating section to produce a sheet, the defibrating section defibrates the raw material cut by the cutting section, and the acquisition section acquires the operation information indicating an occurrence state of at least one of clogging of the raw material in the processing section, stagnation of the raw material cut by the cutting section, and a defective shape of the sheet produced by the forming section.

6. The fiber processing system according to claim 2, wherein:

the processing apparatus processes, by the processing section, the raw material separated by the separation apparatus, the processing apparatus further includes an operation controller that detects operation of the processing section and generates the operation information, and a controller including a transmission section that transmits the operation information to the separation apparatus, and the processor constituting the detection section, the determination section, a reception section, as the acquisition section, that receives operation information, and the setting section.

7. The fiber processing system according to claim 2, further comprising:

a separation apparatus configured to separate the raw material and store the raw material in a raw material container, wherein the processing apparatus is configured to extract the raw material from the raw material container and perform processing by the processing section, wherein the processing apparatus further includes a controller that detects operation of the processing section and generates the operation information, and the controller stores the operation information in a storage section disposed on the raw material container, and the separation apparatus includes a separation section that separates raw material determined, by the determination section to be suitable for processing from raw material determined, by the determination section, to be unsuitable for the processing, and the processor constituting the detection section, the determination section, the acquisition section, and the setting section, and the acquisition section acquires the operation information from the storage section on the raw material container.

8. A fiber processing method comprising:

processing a raw material, the raw material including a fiber, the processing including defibrating the raw material;

detecting a state of the raw material before defibrating the raw material;

determining, based on a preset criterion of a raw material state and a detection result of the state of the raw material, whether the raw material is suitable for processing;

supplying, to a processing section that performs the processing, the raw material determined to be suitable for the processing;

acquiring operation information, the operation information indicating an occurrence state of an operation hindrance in the processing section; and setting, based on the operation information, the preset criterion.

* * * * *